US006802910B2

(12) United States Patent
Murakami et al.

(10) Patent No.: US 6,802,910 B2
(45) Date of Patent: Oct. 12, 2004

(54) CLEANING AND REMANUFACTURING METHODS FOR DEVELOPING CONTAINER

(75) Inventors: Katsuya Murakami, Toride (JP); Mamoru Nagatsuma, Kitasohma-gun (JP); Teruo Suzuki, Mitsukaidoh (JP); Kouzou Nishimura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 83 days.

(21) Appl. No.: 10/040,763

(22) Filed: Jan. 9, 2002

(65) Prior Publication Data

US 2002/0088138 A1 Jul. 11, 2002

(30) Foreign Application Priority Data

Jan. 9, 2001 (JP) ..... 2001-001466

(51) Int. Cl.[7] ..... B08B 5/02; B08B 5/04

(52) U.S. Cl. ..... 134/21; 134/22.1; 134/22.18; 134/24; 134/33; 399/343; 399/348; 399/257; 399/109

(58) Field of Search ..... 134/21, 22.1, 22.18, 134/24, 33; 399/343, 348, 257, 109, 262, 119, 120; 15/300.1, 304

(56) References Cited

U.S. PATENT DOCUMENTS 5,243,388 A * 9/1993 Berns et al. ..... 399/90
6,278,853 B1 * 8/2001 Ban et al. ..... 399/109

* cited by examiner

*Primary Examiner*—Zeinab El-Arini
(74) *Attorney, Agent, or Firm*—Fitzpatrick, Cella, Harper & Scinto

(57) ABSTRACT

A cleaning method for cleaning a developer container includes a step of blowing air through an opening formed in the developer container at a first flow rate; a step of sucking air through the opening at a second flow rate which is larger than the first flow rate; wherein while the blowing and suction steps are being simultaneously carried out, ambient air is permitted to enter the developer container through an ambient air inlet.

20 Claims, 25 Drawing Sheets

(A)

(B)

(C)

CLEANING AND REMANUFACTURING METHODS FOR DEVELOPING CONTAINER

FIELD OF THE INVENTION AND RELATED ART

The present invention relates to cleaning and remanufacturing methods for a developer container for supplying developer to an image forming apparatus such as a copying machine, a printer, a facsimile machine, or the like, which employs an electrophotographic or electrostatic recording method.

It has been a common practice to use toner in the form of microscopic powder, as developer for an image forming apparatus such as a printer. As the amount of the toner in the developer in the main assembly of an image forming apparatus is reduced by consumption to a critical level, the image forming apparatus main assembly is replenished with toner, with the use of a toner supply container removably mountable in the image forming apparatus main assembly.

When supplying an image forming apparatus main assembly with toner, a toner supply container is driven by the driving force from the image forming apparatus main assembly. More specifically, the toner within the toner supply container is conveyed by the stirring/conveying member rotated by the driving force from the image forming apparatus main assembly, and as the stirring/conveying member is rotated, a predetermined small amount of toner is discharged from the toner outlet of the toner supply container to supply the image forming apparatus main assembly with toner.

However, the above described toner supplying method suffered from the following problem.

That is, when assembling a toner container such as the above described one, foreign substances sometimes entered the container. Thus, before filling a toner supply container with toner, the interior of the toner supply container had be cleaned by a cleaning method, for example, by blowing air into the toner container. However, some toner containers have a toner outlet with a relatively small opening, and/or are irregular across their internal surfaces, mating it difficult for air to sweep the entirety of the interior of the toner supply container. In other words, the foreign substances in some toner supply containers were very difficult to remove.

From the standpoint of effective use of natural resources, it is desired that a used toner supply container, that is, a toner supply container depleted of toner, is refilled with toner to be reused. However, some used toner supply containers contain such toner particles that have deteriorated due to their subjection to some kinds of heat during the container transportation Such used toner supply containers must be very carefully cleaned, before recycling, so that the toner particles therein are removed as much as possible. However, the interior of a toner supply container structured as described above is difficult to clean. This has been one of the main problems that have been impeding the recycling of a toner supply container.

SUMMARY OF THE INVENTION

Thus, the primary object of the present invention is to provide a developer supply container cleaning method which is capable of efficiently removing the foreign substances such as unwanted developer in a developer supply container, and which is characterized in that it does not deform a developer supply container during its cleaning.

Another object of the present invention is to provide a developer supply container remanufacturing method which is for reusing a developer supply container by efficiently removing the foreign substances such as unwanted developer in the developer supply container, and which is characterized in that it does not deform a developer supply container during its cleaning.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described with reference to the appended drawings.

Embodiment 1

Figure 1:
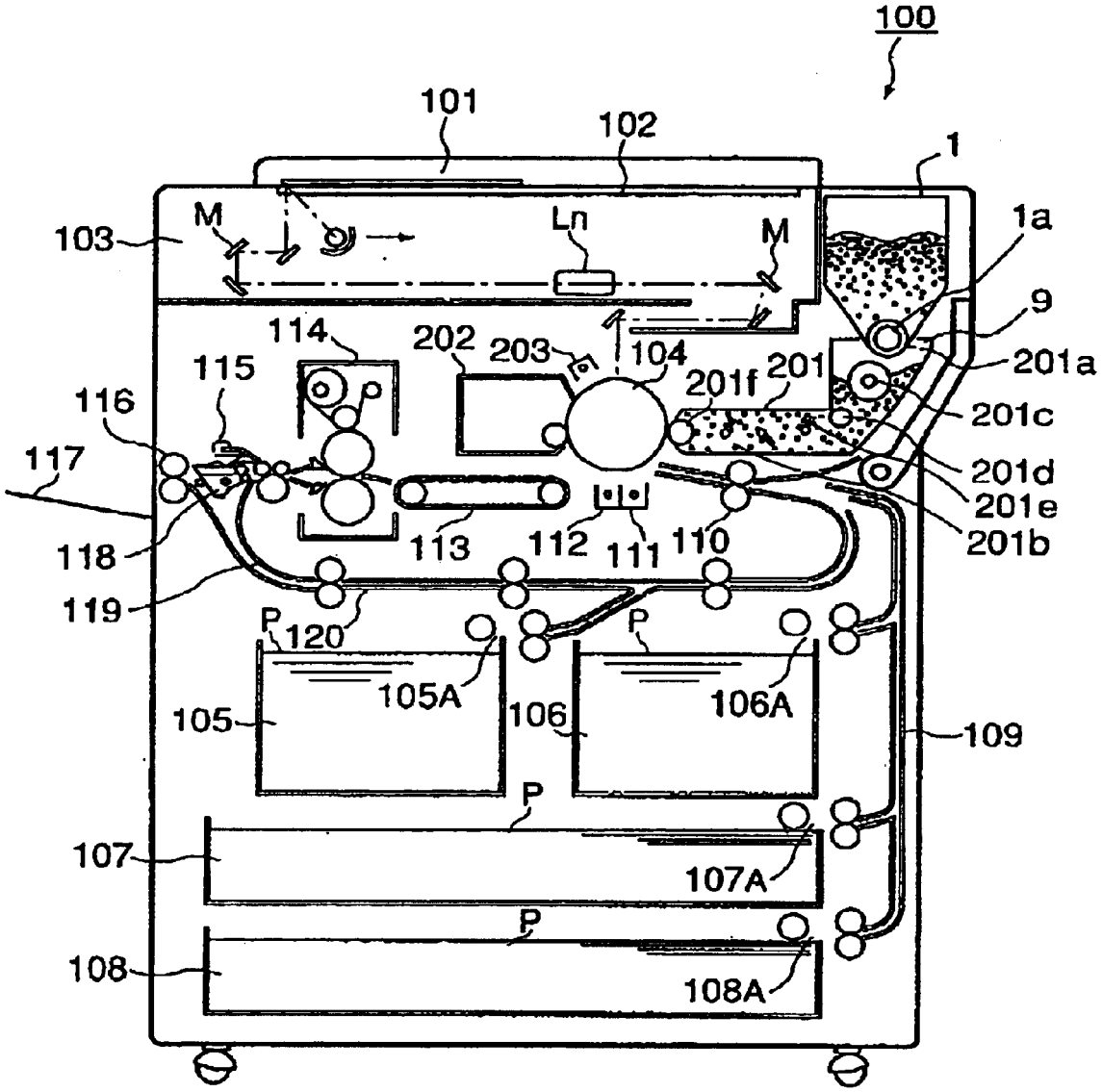
FIG. 1 is a vertical sectional view of an electrophotographic copying machine, that is, an example of an electrophotographic image forming apparatus, into which a toner supply container in accordance with the present invention is mounted, and shows the structure thereof.

First, referring to FIG. 1, the structure of an electrophotographic copying machine, that is, an example of an electrophotographic image forming apparatus, in which a toner supply container in accordance with the present invention is mounted will be described.

In the drawing, a referential code 100 designates the main assembly (which hereinafter will be referred to as the apparatus main assembly) of an electrophotographic copying machine as an image forming apparatus. Designated by a referential code 101 is an original, which is placed on a glass platen 102. The optical image of the original 101 is formed on the peripheral surface of an electrophotographic photoconductive drum 104 through the plurality of mirrors M of an optical portion 103, and the lens Ln of the optical portion 103. Designated by referential codes 105–108 are cassettes, in which a plurality of recording media P (which hereinafter will be referred to as paper) are stored in layers. A paper best suited for the current copying operation is selected based on the information inputted by a user through a control portion 100 shown in FIG. 2, or a paper size of the original 101, is selected based on the paper size information of the cassettes 105–108. It should be noted here that the selection of the recording medium does not need to be limited to paper; if necessary, paper may be replaced with an OHP sheet or the like.

The papers P are fed into the apparatus main assembly one by one by the feeding/separating apparatuses 105A–108A. Thereafter, each paper P is conveyed to a registration roller 110 by way of a conveying portion 104, and then, is released by the registration roller 110, to be conveyed to the photoconductive drum 104, in synchronism with the rotation of the photoconductive drum 104 and the scanning timing of the optical portion 103. Referential codes 111 and 112 designate a transfer charging device and a separation charging device, respectively. The toner image formed on the peripheral surface of the photoconductive drum 104 is transferred onto the paper P by the transfer charging device 111. Then, the paper P, onto which the toner image has been transferred is separated from the photoconductive don 104 by the separation charging device 112.

Thereafter, the paper P is conveyed by the conveying portion 113 to a fixing portion 114, in which the unfixed toner image on the paper P is fixed to the paper P with the use of heat and pressure. Then, when the copying apparatus is in the single-sided printing mode, the paper P is discharged by a pair of paper discharge rollers 116 into a delivery tray 117 through a discharging/reversing portion 115, whereas when the copying machine is in the double-sided printing mode, the flapper 118 of the discharging/reversing portion 115 is controlled to convey the paper P through the double-sided mode sheet conveyance paths 119 and 120 to the registration roller 110, and then, is discharged into the delivery tray 117 after being passed through the same paths as those through which the paper P is passed when in the single-side printing mode.

When in the multilayer printing mode, the paper P is partially discharged by the paper discharge rollers 116 from the apparatus main assembly after being passed through the discharging/reversing portion 115. Then, while the trailing end of the paper P, which has passed by the flapper 118, is still held by the discharge rollers 116, that is, being pinched by the discharge rollers 16, the flapper 118 is controlled so that the paper discharge rollers 116 convey the paper P back into the apparatus main assembly. Then, the paper P is conveyed through the double-sided mode sheet conveyance paths 119 and 120 to the registration roller 110, from which the paper P is conveyed through the same paths as those through which it is passed when in the single-sided printing mode, and is discharged into the delivery tray 117.

In the apparatus main assembly 100 structured as described above, a developing portion 201, a cleaning portion 202, a primary charging device 203, and the like, are disposed in a manner to surround the peripheral surface of the photoconductive drum 104. The developing portion 201 is a portion for developing, with the use of developer, an electrostatic latent image formed on the peripheral surface of the photoconductive drum 104 by the optical portion 103, in accordance with the data from the original 101. To this developing portion 201, toner is supplied by a toner supply container 1 as a developer container, which is removably mounted into the apparatus main assembly 100 by a user. The developing portion 201 is provided with a toner hopper 201*a* and a developing device 201*b*. The toner hopper 210*a* has a stirring member 201*c* for stirring the toner supplied from the toner supply container 1. The toner having been supplied from the toner supply container 1 is sent, while being stirred by the stirring member 201*c*, to the developing device 201*b* by a magnetic roll 201*d*. The developing device 201*b* has a development roller 201*f* and a sending member 201*e*. After being sent by the magnetic roll 201*d* from the toner hopper 201*a*, the toner is sent by the sending member 201*e* to the development roller 201*f*, by which the toner is supplied to the photoconductive drum 104.

The cleaning portion 202 is a portion for removing the toner particles remaining on the photoconductive drum 104. The primary charging device 203 is a device for charging the photoconductive drum 104.

Figure 2:
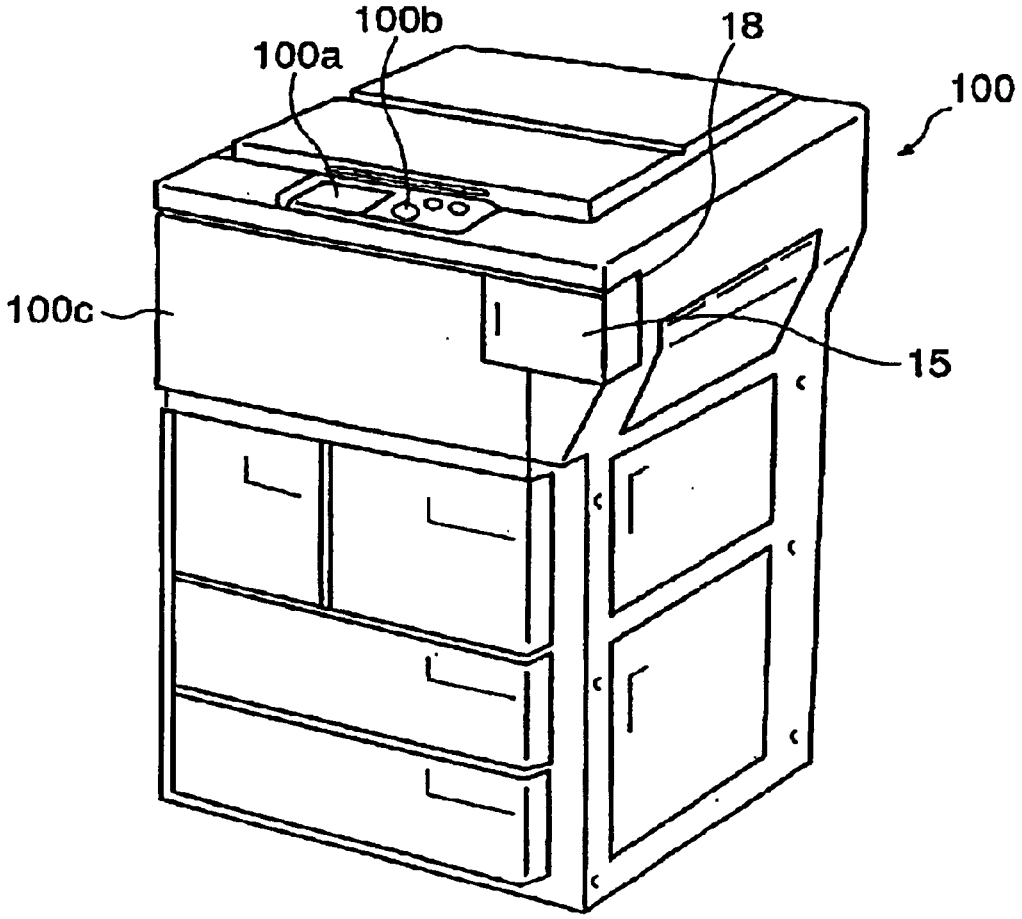
FIG. 2 is a perspective view of the electrophotographic copying machine in FIG. 1.
Figure 3:
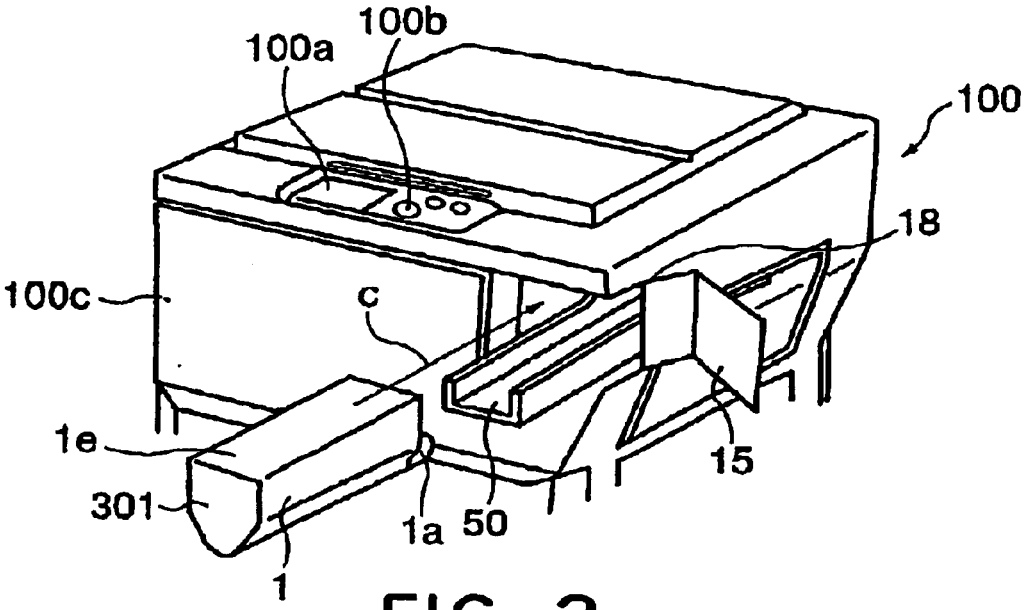
FIG. 3 is a perspective view of the top portion of the electrophotographic copying machine in FIG. 1, the cover of which for mounting a toner supply container into the apparatus main assembly, or dismounting it therefrom has been opened to allow a toner supply container in accordance with the present invention to be mounted into the copying machine.

Referring to FIG. 2, a referential code 15 designates a cover (which hereinafter will be referred to as toner supply container mounting/dismounting cover), which is for mounting or dismounting the toner supply container 1, and a part of the external shell of the image forming apparatus. As the cover 15 is opened by a user as shown in FIG. 3, a toner container tray 50 is pulled out by a driving system (unshown) to a predetermined point. The toner supply container 1 is placed on this toner container tray 50. In order for the user to take the container 1 out of the apparatus main assembly 100, the user is to remove the toner supply container 1 on the container tray 50, after pulling the tray 50 out of the apparatus main assembly 100. The cover 15 is a cover dedicated for mounting, dismounting, or replacing, the toner supply container 1, and is opened or closed only for mounting or dismounting the toner supply container 1. For the maintenance of the apparatus main assembly 100, the front cover 100*c* is opened or closed.

The image forming apparatus design may be such that the toner supply container 1 is directly placed in the apparatus main assembly 100, or removed therefrom, without the provision of the toner supply container tray 50.

Next, one of the preferred embodiments of the toner supply container in accordance with the present invention will be described.

In this embodiment, the conveying member does not double as the stirring member, and the conveying member and stirring member are set up as the components of the toner supply container 1.

Figure 4:
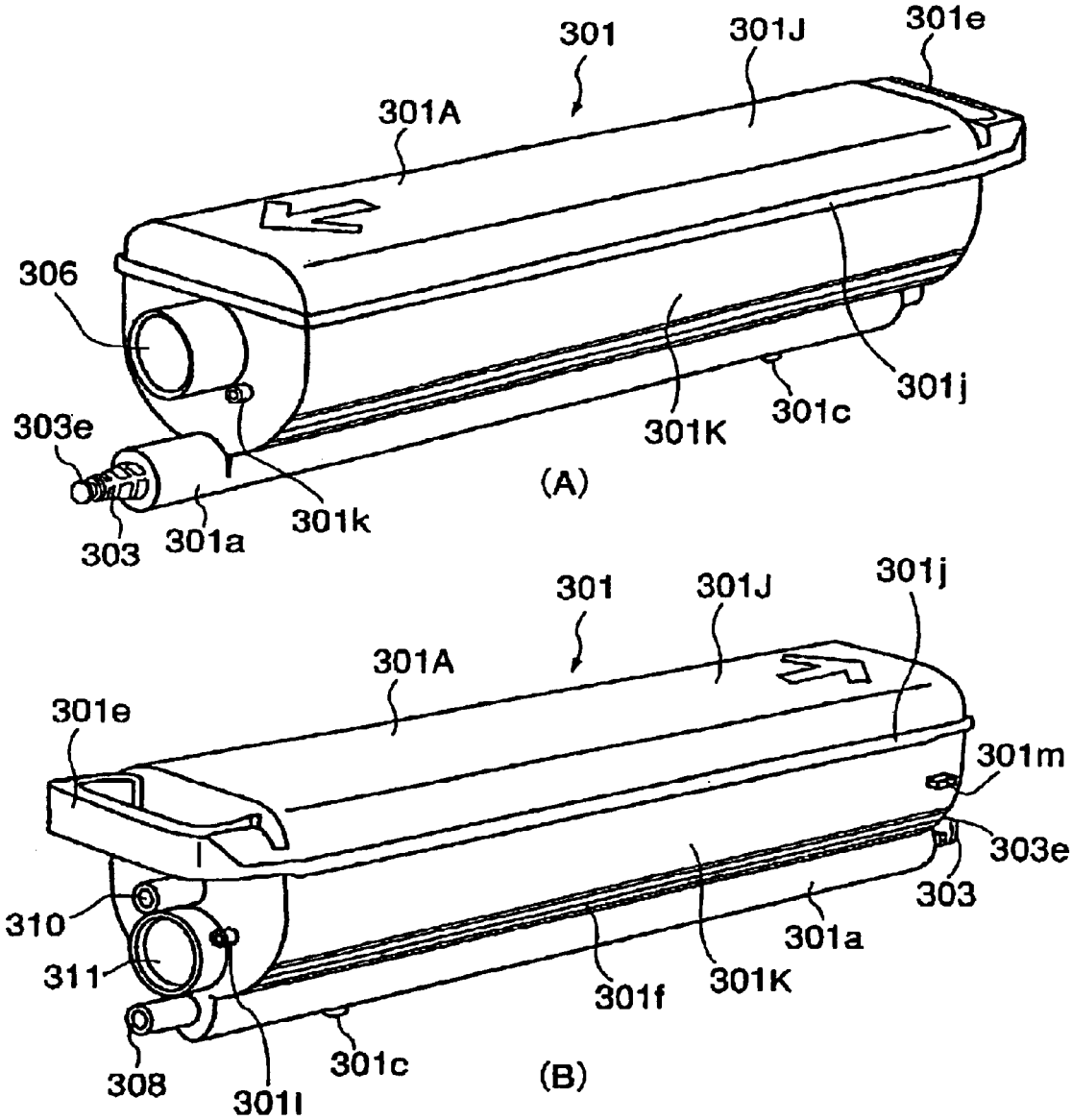
FIGS. 4(A) and 4(B) are perspective views of a toner supply container in accordance with the present invention, as seen from the side on which a sealing member is provided, and the side on which a handle is provided, respectively.
Figure 5:
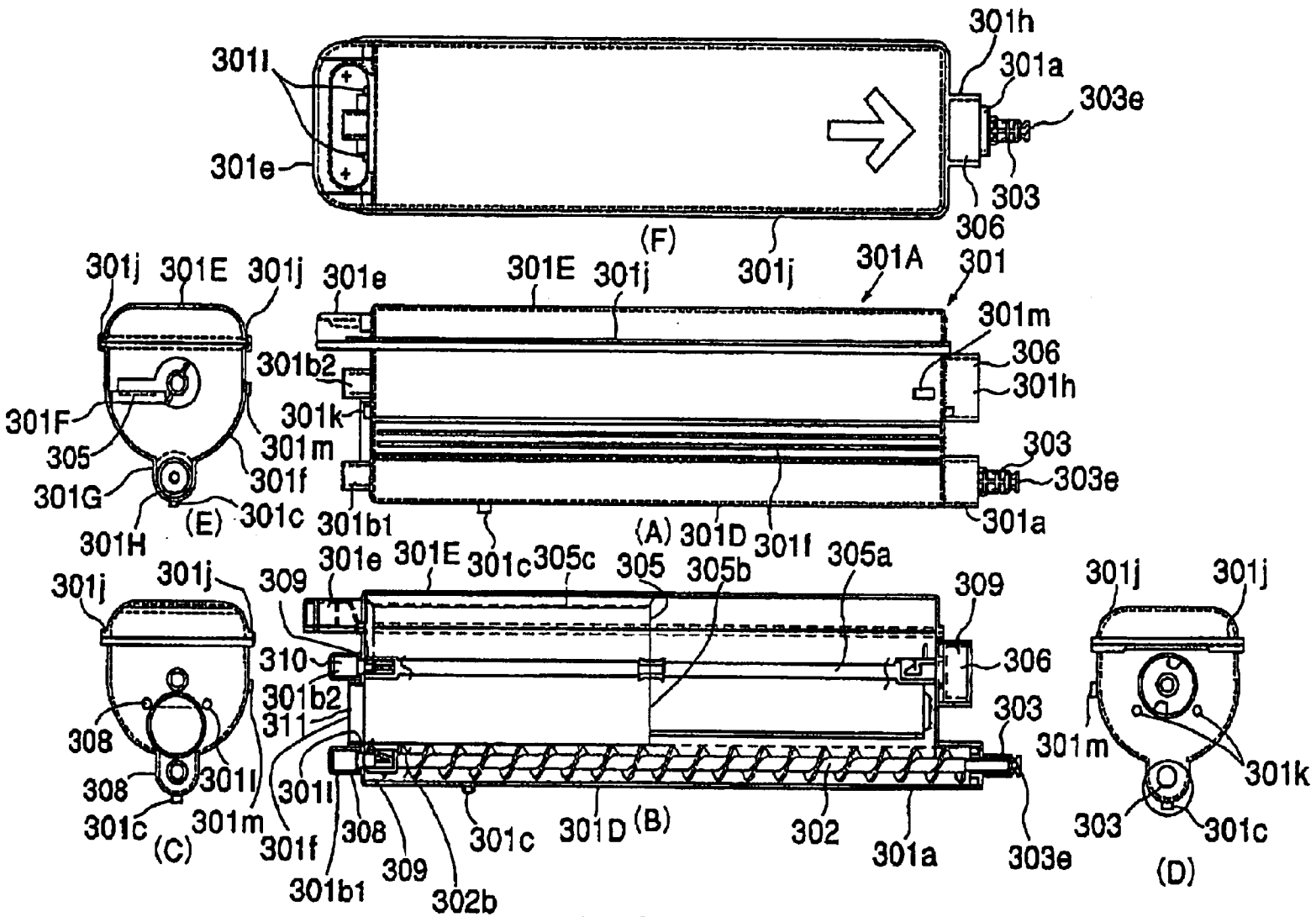
FIGS. 5(A), 5(B), 5(C), 5(D), 5(E), and 5(F) are front view, vertical sectional view, parallel to the lengthwise direction, left side view, right side view, and vertical sectional view, perpendicular to the lengthwise direction, correspondingly, of the toner supply container in accordance with the present invention.

FIG. 4 is a perspective view of the toner supply container 301 in this embodiment of the present invention.

Figure 6:
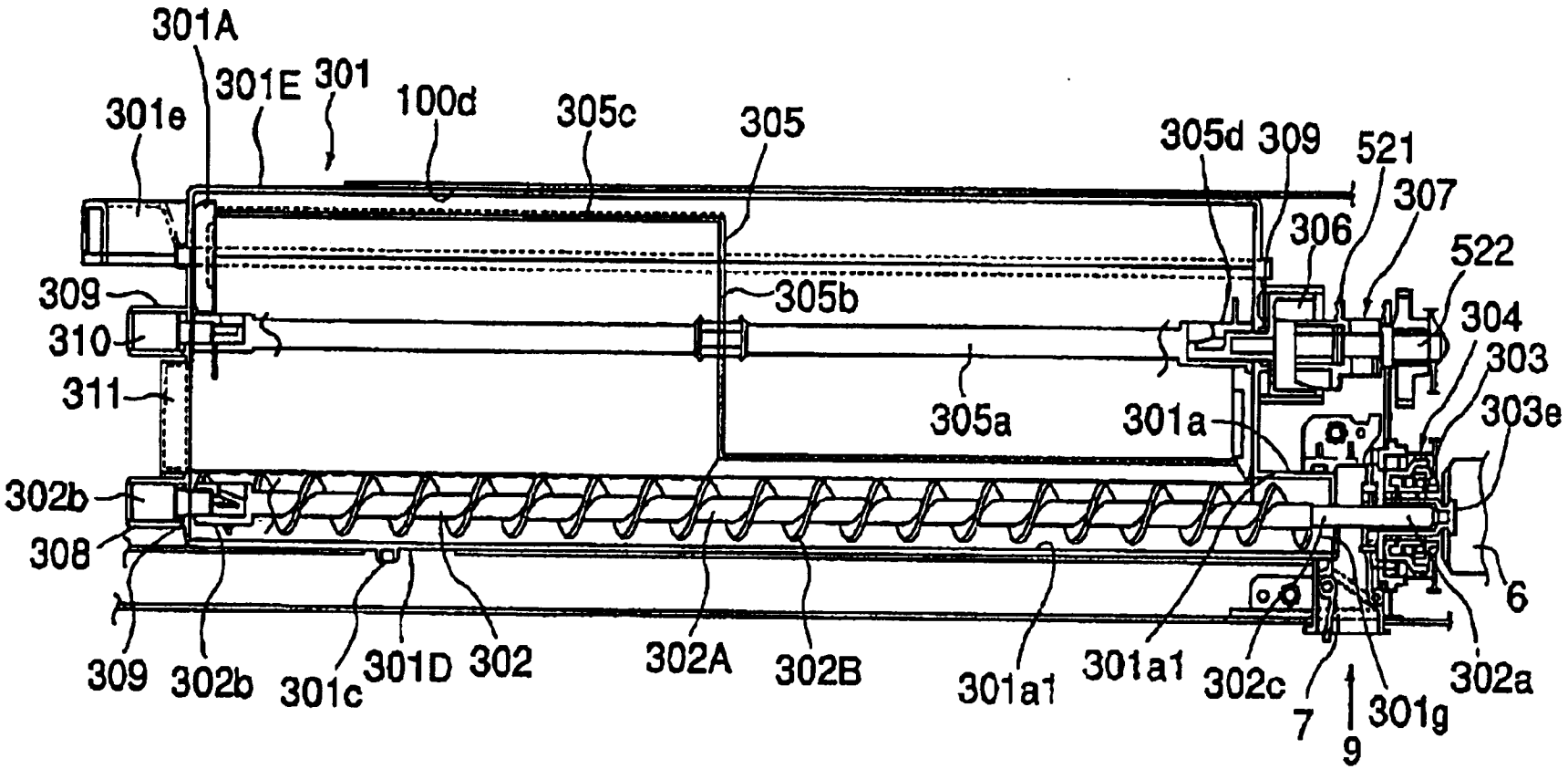
FIG. 6 is a vertical sectional view, parallel to the lengthwise direction, of the toner supply container in accordance with the present invention, which is in the image forming apparatus main assembly, and the toner outlet of which has been sealed
Figure 7:
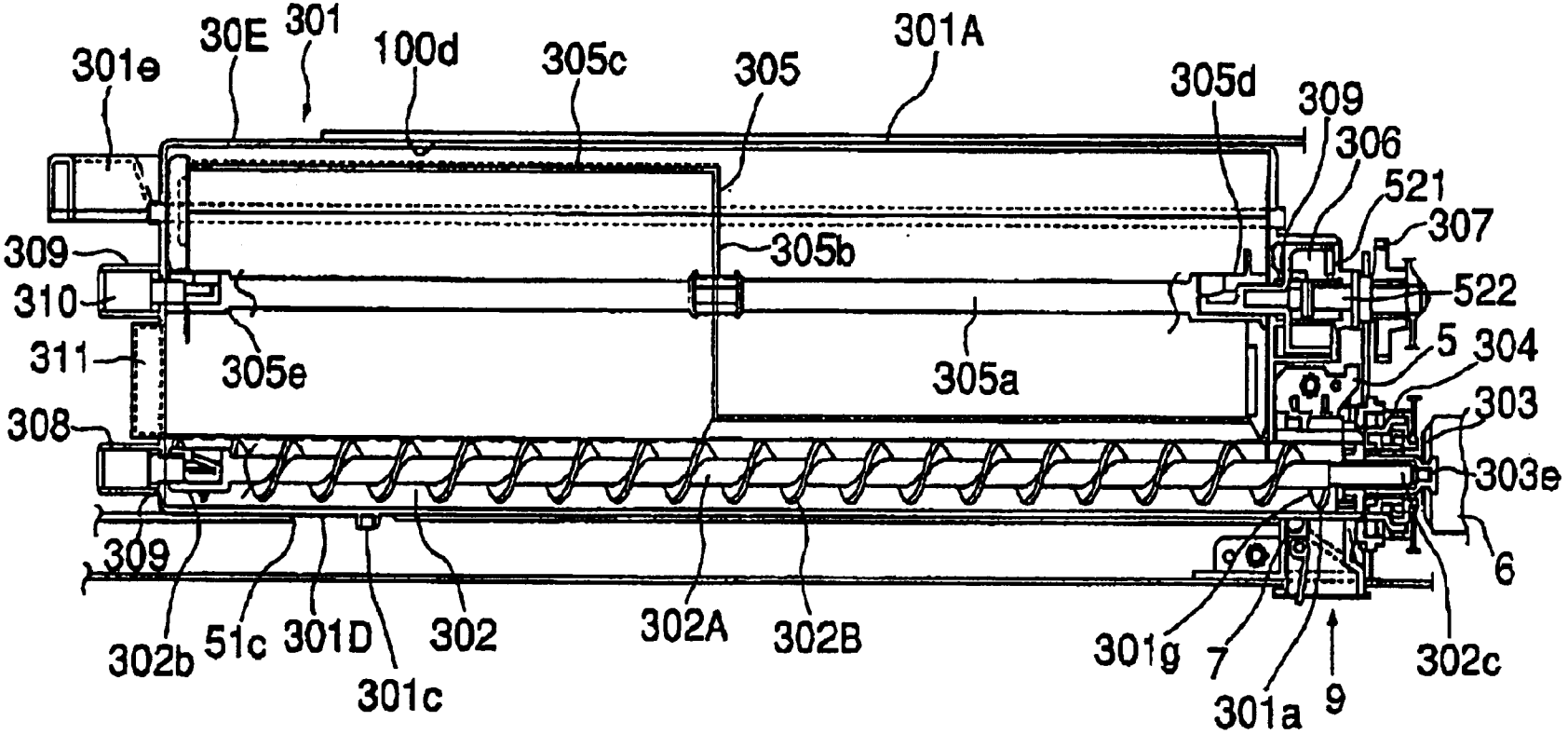
FIG. 7 is also a vertical sectional view, parallel to the lengthwise direction, of the toner supply container in accordance with the present invention, which is in the image forming apparatus main assembly, and the toner outlet of which has been unsealed

FIGS. 5(A), 5(B), 5(C), 5(D), 5(E), and 5(F) are front view, vertical sectional view, parallel to the lengthwise direction, left side view, right side view, and vertical sectional view, perpendicular to the lengthwise direction, and top view, correspondingly, of the toner supply container in accordance with the present invention. FIG. 6 is a vertical sectional view, parallel to the lengthwise direction, of the toner supply container 1, which has been mounted in the apparatus main assembly 100, and the toner outlet of which has been unsealed. FIG. 7 is a vertical sectional view, perpendicular to the lengthwise direction, of the toner supply container 1, which has been mounted in the apparatus main assembly 100, and the toner outlet of which has been sealed.

Referring to FIGS. 4 and 7, a referential code 301A designates the actual toner storage portion of the toner supply container Referring to FIGS. 6 and 7, designated by a referential code 302 is a conveying member for conveying the toner in the toner storage portion 301A, toward the toner outlet 301*a* of the toner supply container 1. A referential code 303 designates a sealing member for sealing the toner outlet 301*a*, and a referential code 304 designates a coupling member for transmitting driving force to the sealing member 303 after the mounting of the toner supply container 1 into the apparatus main assembly 100. A referential code 305 designates the stirring member for stirring the toner within the toner storage portion 301A, and a referential code 306 designates a transmitting member which engages with the stirring member 305 to transmit the rotational driving force from the image forming apparatus main assembly 100 to the stirring member 305. A referential code 307 designates a coupling member for transmitting the driving force to the transmitting member 306 after the mounting of the toner supply container 1 into the apparatus main assembly 100.

Designated by a referential code 309 is a toner seal for preventing toner leakage.

Figure 8:
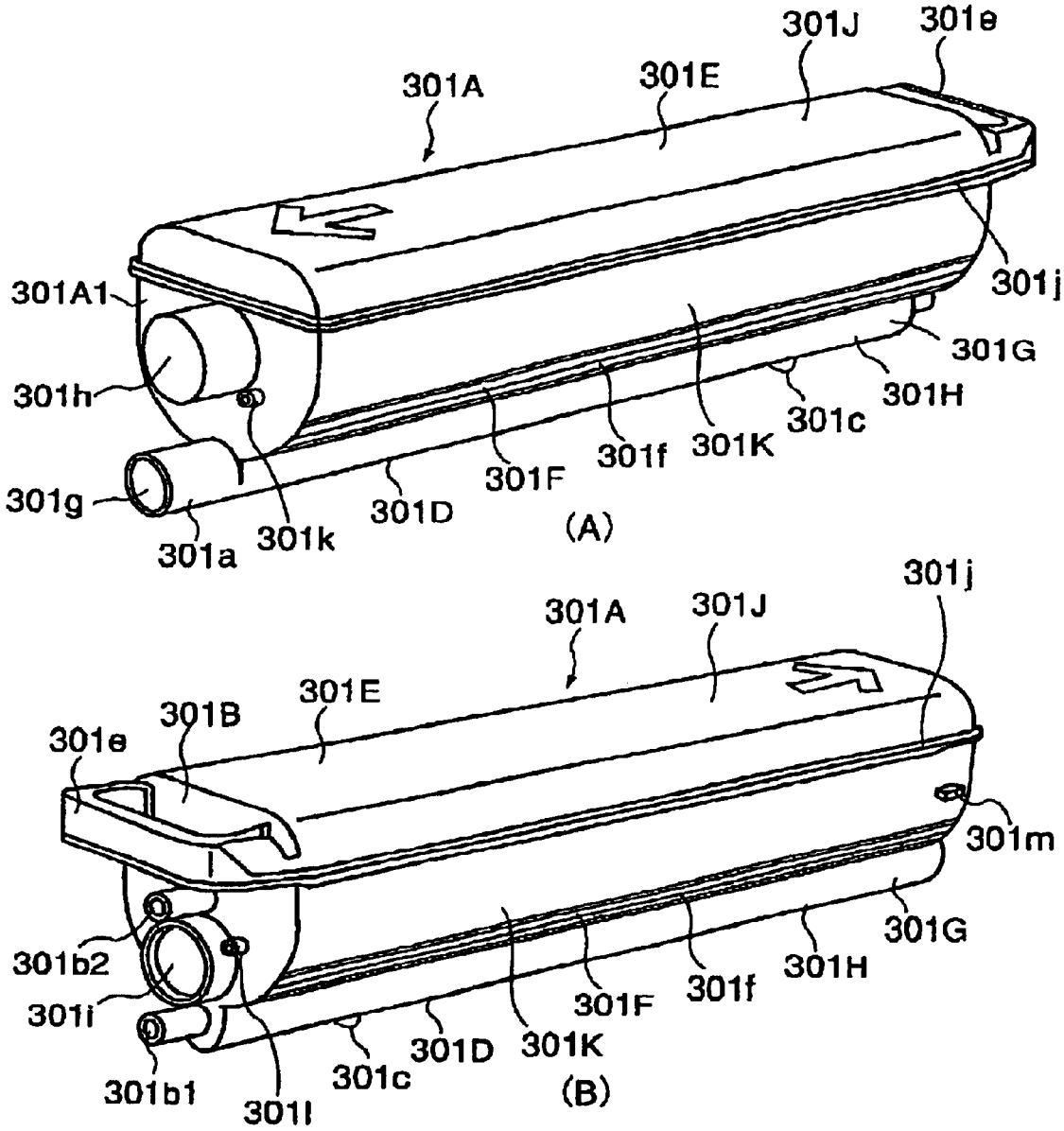
FIGS. 8(A) and 8(B) are perspective views of the toner supply container in accordance with the present invention, as seen from the side on which the toner inlet is provided, and the side on which a handle is provided.
Figure 9:
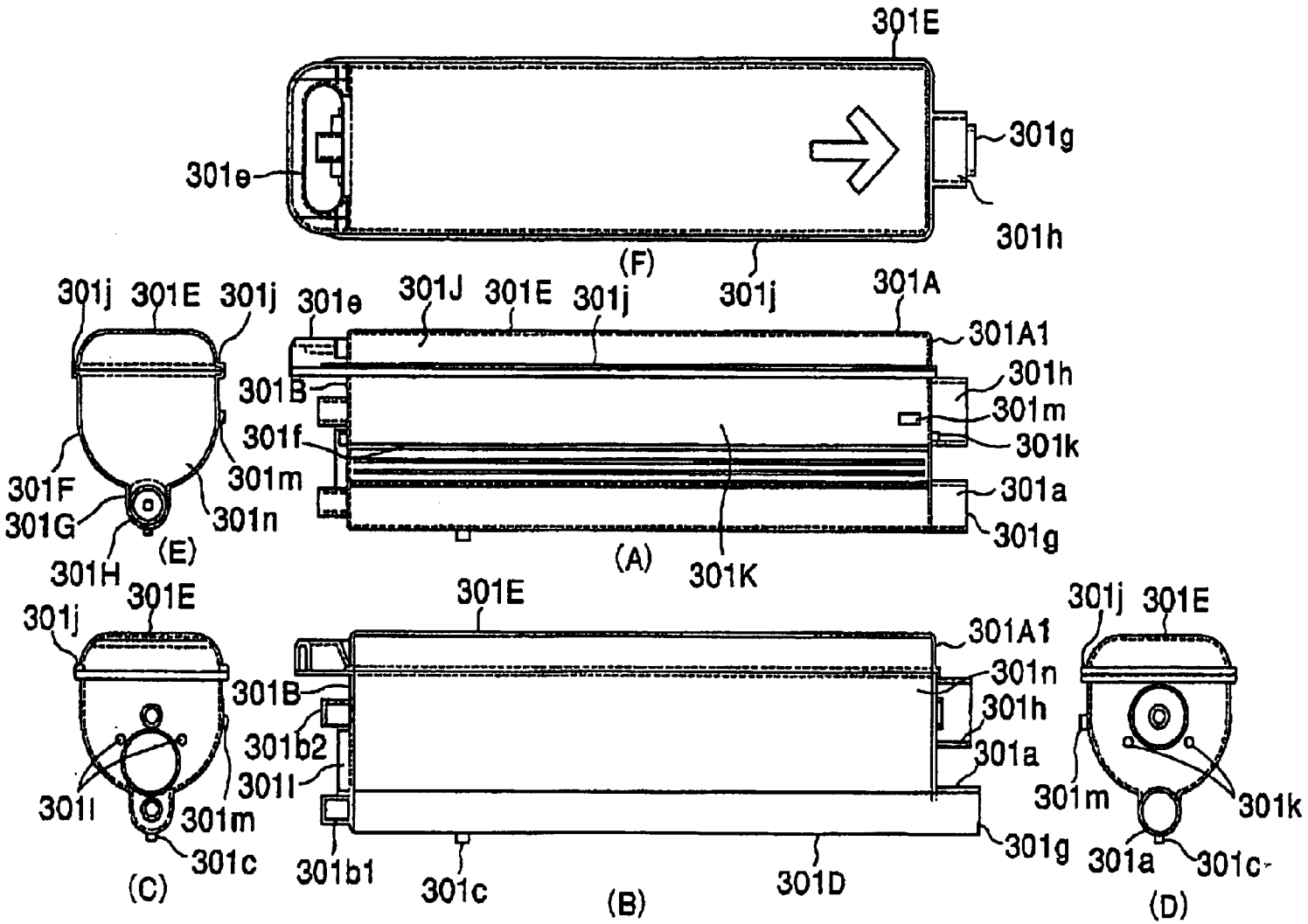
FIGS. 9(A), 9(B), 9(C), 9(D), 9(E), and 9(F) are front view, vertical sectional view, parallel to the lengthwise direction, left side view, right side view, vertical sectional view, perpendicular to the lengthwise direction, and top view, correspondingly, of the toner supply container in accordance with the present invention

At this time, referring to FIGS. 8 and 9, the actual toner storage portion 301A, or the main structure of the toner supply container 1, will be described. FIG. 8 is a perspective view of the container main structure, or the actual toner storage portion, of the toner supply container 1.

FIGS. 9(A), 9(B), 9(C), 9(D), 9(E), and 9(F) are front view, vertical sectional view, left side view, right side view, sectional view, perpendicular to the lengthwise direction, and top view, of the toner storage portion, or the main structure, of the toner supply container 1.

In terms of the cross section perpendicular to the lengthwise direction, the toner storage portion 301A roughly comprises three portions: a roughly U-shaped portion 301F, the width of which gradually reduces toward the bottom; a rectangular portion 301G, which continues downward from the bottom portion of the roughly U-shaped portion 301F, and the width of which is virtually uniform from the top to bottom; and a semispherical portion 301H, which continues downward from the bottom of the rectangular portion 301G.

The toner storage portion 301A is provided with the cylindrical toner outlet 301*a*, which is for supplying the toner in the toner storage portion to the apparatus main assembly 100, and projects from the bottom of one of the walls of the toner storage portion 301A, at the lengthwise end. The toner outlet 301*a* is provided with an opening 301*g*, which is at the outward end. The other wall of the toner storage portion 301A, in terms of the lengthwise direction, is provided with a first bearing portion 301*b*1 which is for rotationally supporting the conveying member 302, and the position of which corresponds to that of the toner outlet 301*a*. Further, the exterior of the bottom wall 301D of the toner storage portion 301A is provided with an aligning portion 301*c*, which is for aligning the toner supply container with the apparatus main assembly 100 when the toner supply container 1 is mounted into the apparatus main assembly 100. This aligning portion 301*c* also functions as a latching portion 301*c*, which latches on the toner outlet sealing/unsealing means of the apparatus main assembly 100 so that the toner supply container 1 can be moved in the direction in which the toner supply container 1 is mounted or dismounted. In this embodiment this latching portion 301*c* is in the form of a joggle projecting downward from the external surface of the bottom wall 301D. The top wall 301E of the toner storage portion 301A is provided with a handle 301*e*, which is grasped by a user when the toner supply container 301 is mounted into, or dismounted from, the apparatus main assembly 100. The front and back walls of the roughly U-shaped portion 301F in FIG. 9(E) are provided with a plurality of grooves 301*f*, which extend in parallel in the lengthwise direction of the toner storage portion 301A to make it easier for a user to hold the toner storage portion 301A when mounting the toner supply container 301 into the apparatus main assembly 100.

Further, the other end wall 301B is provided with a second bearing seat portion 301*b*2, which is located above the first bearing seat portion 301*b*1 to rotationally encase the stirring member 305.

In terms of the lengthwise direction of the container main structure 301A, the toner outlet 301*a* is on the end wall 301A1, which is the opposite wall with respect to the end wall 301B on which the handle 301*e* is provided. Therefore, it is possible to prevent a user from accidentally touching the toner outlet 301*a* when mounting the toner supply container 301 into the apparatus main assembly 100. Further, the toner outlet 301*a* is on the bottommost side of the end wall 301A1. Therefore, even after the toner within the toner supply container 301 has reduced by a substantial amount, it can be efficiently discharged through the toner outlet 301*a*.

The toner outlet 301*a* is desired to project approximately 20 mm–40 mm, preferably approximately 27.8 mm. It is cylindrical, being desired to be 20 mm 40 mm in external diameter, preferably, 26 mm–29 mm, most preferably, approximately 27.6 mm.

As described before, the external surface of the bottom wall 301D is provided with the latching portion 301*c*, which is aligned with the recess 51C (FIG. 7) of the toner supply container tray 51 of the apparatus main assembly 100. Also as described before, this latching portion 301*c* is in the form of a cylindrical joggle which projects downward from the external surface of the bottom wall 301D. The external diameter of this cylindrical joggle is desired to be 5 mm–12 mm, preferably, approximately 8 mm. The aligning portion is desired to project 2 mm–8 mm from the bottom wall 301D. In terms of the lengthwise direction of the bottom wall 301D, the latching portion 301*c* (aligning portion) is located 60 mm–80 mm, preferably, approximately 71 mm, from the end wall 301B, or the opposite end wall with respect to the side on which the toner outlet 301*a* is present.

The latching portion 301*c* (aligning portion) is desired to be cylindrical, but it may be in the form of a rectangular pillar, a semicylindrical pillar, or the like.

The end walls 301A1 and 301B are each provided with a pair of bosses 301*k* and 301*l* for aligning the container main structure 301A to check the measurements of the container main structure 301A before shipping the toner supply container 301 from the factory.

A referential code 301*m* designates a rib for preventing erroneous mounting.

Providing one type of a toner supply container with the rib 301*m* different, in the position relative to the toner supply container, from the ribs 301*m* on the other types of toner supply containers makes it possible to prevent a user from mounting the wrong type of toner supply container into the apparatus main assembly 100.

The container main structure 301A of the toner supply container 301 is desired to be manufactured of resinous substance such as plastic by injection molding, blow molding, injection/blow molding, or the like. However, the material and manufacturing methods for the container main structure 301A may be those other than the above listed ones. Further, for convenience, the container main structure 301A may be molded in two or more pieces, which are integrated into a monolithic structure by such means as welding or gluing.

In this embodiment, the container main structure 301A was injection molded of high impact polystyrene, in two pieces, that is, the top and bottom pieces, which were welded by vibration welding into a monolithic structure.

Referring to FIG. 6, the conveying member 302 is provided with a shaft portion 302A and a spiral conveyance blade portion 302B. The conveyance blade portion 302B is a rigid component attached to the shaft portion 302A, and as the shaft portion 302A is rotated, the conveyance blade portion 302B conveys the powdery toner in a predetermined direction. The conveying member 302 is attached to the container main structure 301A, with the axial line of the shaft portion 302A coinciding with the center of the virtually circular toner outlet opening 301*g*.

The type of the conveying member 302 does not need to be limited to the above described one, that is, the so-called screw type. Instead, the conveying member 302 may be a combination of the shaft portion 302A, and a flexible blade portion attached to the shaft 302A, or the like combinations. Further, the shaft and blade portions way be integrally formed, or may be integrated after being separately formed. In this embodiment, the shaft portion 302A and blade portion 302B are integrally formed of plastic.

Further, in this embodiment, the conveying member 302 has a bladeless portion 302*c*, which constitutes one of the lengthwise end portions, and fits within the cylindrical toner outlet 301*a*. In this embodiment, this bladeless portion is long enough to project outward of the toner outlet 301*a*. The rotational driving force from the apparatus main assembly 100 is received by the projecting end portion 302*a* of the bladeless portion 302*c*. Thus, the end of the bladeless portion 302*c* of the conveying member 302 is fitted with a sealing member 303, which is allowed to move in the axial direction of the conveying member 302.

The end portion 302*a* of the bladeless portion 302*c* of the conveying member 302 is given such a shape as a polygonal pillar that enables the conveying member 302 to receive the rotational driving force from the apparatus main assembly 100 through the sealing member 303. In this embodiment, it is in the form of a square pillar. One end of the shaft portion 302A is supported by the sealing member 303; the end portion 302*a* of the bladeless portion 302*c* of the shaft portion 302A is supported by the sealing member 303. The other end of the shaft portion 302A is provided with a first bearing member 308. Thus, the conveying member 302 is supported by the container main structure 301A, with the interposition of the first bearing member 308, so that the conveying member 302 can be freely rotated after the unsealing of the toner outlet 301*a*.

Also referring to FIG. 6, the conveying member 302 is supported by the sealing member 303 so that the conveyance blade portion 302B does not contact the cylindrical internal surface 301*a*1 of the toner outlet 301*a*, and also so that the cylindrical internal surface of the toner outlet 301*a* is made approximately parallel to the shaft portion 302*a*. Supporting the conveying member 302 as described above makes it possible for the toner to be approximately horizontally conveyed toward the opening 301*g* of the toner outlet 301*a*, by the rotation of the conveying member 302. It also prevents the occurrence of the following phenomenon, the microscopic toner particles are compacted between the cylindrical internal surface 301*a*1 of the toner outlet 301*a*, and the edge of conveyance blade portion 302B, and as a result, they are rigorously rubbed amongst themselves and against the surface and edge, being melted thereby, and are welded to the cylindrical internal surface of the toner outlet 301*a*, being thereby agglutinated into larger toner particles.

As described before, for convenience, the conveying member 302 is also desired to be formed of resinous substance such as plastic, with the use of such a manufacturing method as injection molding. However, materials and methods other than the above described one may be employed. Further, the conveying member 302 may be manufactured in an optional number of pieces, which are joined into a single piece.

Figure 10:
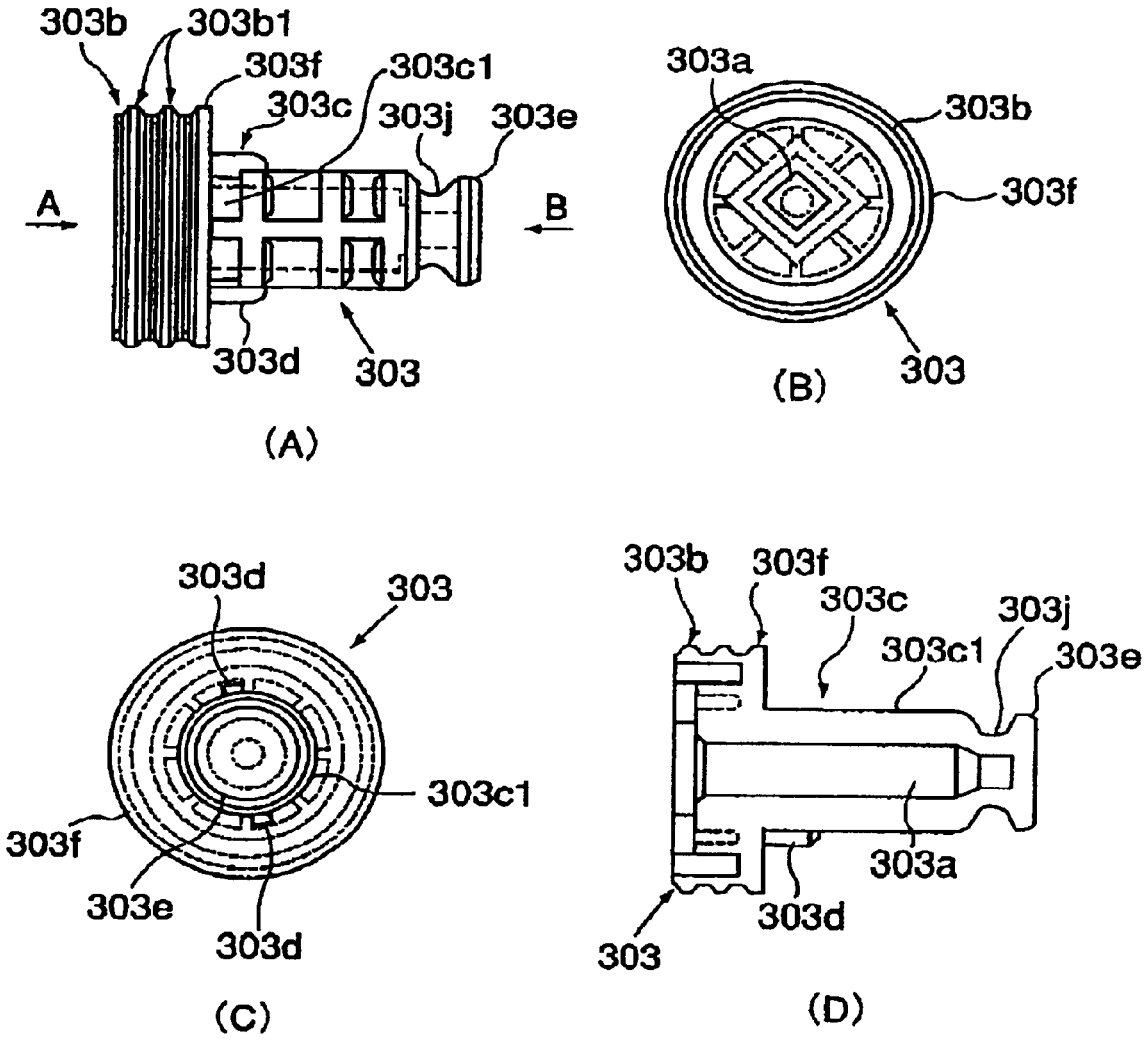
FIGS. 10(A), 10(B), 10(C), and 10(D) are front view, side view as seen from the direction indicated by an arrow mark in 10(A), side view as seen from the direction indicated by an arrow mark B in FIG. 10(A), and vertical sectional view, parallel to the lengthwise direction, correspondingly, of the sealing member in accordance with the present invention.

Next, referring to FIG. 10, the sealing member 303 will be described. FIG. 10(A) is a front view of the sealing member 303. FIGS. 10(B) and 10(C) are side views of the sealing member 303 as seen from the directions of arrow marks A and B, respectively. FIG. 10(D) is a vertical sectional view of the sealing member 303, parallel to the axial direction of the sealing member 303.

In FIGS. 10(A)–10(D), a referential code 303*b* designates the sealing portion of the sealing member 303 for sealing or unsealing the toner outlet opening 301*g* of the toner outlet 301. The sealing portion 303*b* constitutes the toner supply container side of the sealing member 303. The external diameter of the sealing portion 303*b* is greater by an appropriate amount than the internal diameter of the toner outlet opening 301*g*. The toner outlet opening 301*g* is hermetically sealed with the sealing member 303, by pressing the engaging portion 303*b*1 of the sealing portion 303*b* into the toner outlet 301*a* through the opening 301*g*.

Designated by a referential code 303*c* is the coupling portion (male type) of the sealing member 303, which constitutes the driving force receiving portion (driven portion) of the sealing member 303. The driving force for rotating the conveying member 302 after the mounting of the toner supply container 301 into the apparatus main assembly 100 is received by this coupling portion 303*c*. The coupling portion 303*c* is provided with a cylindrical portion 303*c*1, which projects from the coupling portion 303*c*, from the side opposite to the sealing portion 303*b*. The axial line of the cylindrical portion 303*c*1 coincides with that of the shaft portion 302A. Further, the coupling portion 303*c* is provided with a plurality of spline-like ribs 303*d*, which constitute the actual driving force receiving portions of the sealing member 303 and engage with the coupling member 304 on the apparatus main assembly side. In this embodiment, the coupling portion 303*c* is provided with two of these spline-like ribs 303*d*, which are positioned with approximately equal intervals in terms of the circumferential direction of the coupling portion 303*c*.

More concretely, the coupling portion 303*c* in this embodiment is provided with two spline-like ribs 303*d*, which are approximately 180° apart from each other in terms of the circumferential direction with respect to the axial line of the sealing member 303.

The height of each rib 303*d* from the peripheral surface of the coupling portion 303*c* is desired to be 0.5 mm–3 mm, preferably, approximately 1.8 mm.

The external diameter of the above described projecting cylindrical portion 303*c*1 is desired to be 10 mm–14 mm, preferably, approximately 12 mm.

Further, the sealing member 303 is provided with a coupling hole 303*a* as a driving force transmitting portion, which engages with the end portion 302*a* of the conveying member 302 and transmits to the conveying member 302, the driving force which the sealing member receives from the apparatus main assembly 100. This coupling hole 303*a* extends through the centers of the sealing portion 303*b* and coupling portion 303*c* of the sealing member 303 in the axial direction of the sealing member. The cross section of the coupling hole 303*a* is square, which corresponds to the square cross section of the end portion 302*a* of the shaft portion 302A of the conveying member 302, which projects from the toner outlet opening 301*a*. The size of the cross section of the coupling hole 303*a* is made slightly larger than that of the end portion 302*a* of the shaft portion 302A of the conveying member 302 to allow the shaft end portion 302*a* to loosely fit in the coupling hole 303*a*.

With the provision of the play between the shaft end portion 302*a* and coupling hole 303*a* in terms of the radial direction of the sealing member 303 as described above, the conveying member 302 and sealing member 303 latch onto each other in terms of the rotational direction of the conveying member 302, while being allowed to move relative to each other in terms of their axial direction. Thus, when mounting the toner supply container 301, the sealing member 303 can be disengaged from the container main structure 301A, or the actual toner storage portion, to unseal the toner outlet opening 301*g*.

The length by which the coupling hole 303*a* and shaft end portion 302*a* are engaged with each other is large enough to prevent the shaft end portion 302*a* from entirely coming out of the coupling hole 303*a* when the sealing member 303 is separated from the container main structure 301A. With the provision of this structural arrangement, even after the sealing member 303 is separated from the container main structure 301A, the conveying member 302 can receive the driving force through the sealing member 303 (coupling portion 303*c*).

The sealing member 303 is also provided with a flange portion 303*f*, which is located between the coupling portion 303*c* and sealing portion 303*b*. The flange portion 303*f* comes into contact with the lip portion of the toner outlet 303*a* as the sealing portion 303*b* is pressed into the toner outlet 301*a*. The external diameter of this flange portion 303*f* is approximately the same as that of the toner outlet 303*a* (preferably, smaller than the external diameter of the toner outlet 301*a*). With the presence of the flange portion 303*f*, the sealing member 303 is allowed to be pressed into toner outlet 301*a* only by the length equal to the sealing portion 303*b*.

The portion of the sealing member 303 designated by a referential code 303*e* is a securing lip which engages with the securing member 6 provided on the apparatus main assembly 100 side. The securing lip 303*e* is at the end of the coupling portion 303*c*. This securing lip 303*e* engages with the securing member 6 (FIG. 7) to secure the sealing member 303 when unsealing the toner outlet opening 301*g*.

It is also desired that the sealing member 303 structured as described is formed of resinous substance such as plastic, with the use of such a manufacturing method as injection molding. However, materials and manufacturing methods other than the above described ones may be employed. Further, the sealing member 303 may be manufactured with the use of a method in which the sealing member 303 is formed in an optional number of pieces, and then, the pieces are joined into a monolithic sealing member 303. The sealing member 303 is pressed into the toner outlet 301*a* to seal the container main structure 301A. Therefore, it is required to have a proper amount of elasticity. Thus, low density polyethylene is most desirable as the material for the sealing member 303. The preferable materials for the sealing member 303 next in line are polypropylene, nylon, high density polyethylene, and the like.

A referential code 303*j* designates a sealing member securing groove into which the securing member 6 of the apparatus main assembly 100 engages. The width of this securing groove 303*j* is desired to be 1.5 mm–5 mm, preferably, approximately 3 mm. The depth of the securing groove 303*j* is desired to be 0.5 mm–5 mm, preferably, approximately 2.5 mm.

As described above, the sealing member 303 has the virtually cylindrical sealing portion 303*b* with a plurality of sealing ridges 303*b*1 which fits into the toner outlet 301*a*. The sealing member 303 also has the flange portion 303*f*, the axial line of which coincides with that of the sealing portion 303*b*. The sealing member 303 also has the projecting cylindrical portion 303*c*1, the axial line of which coincides with that of the sealing portion 303*b*. Further, the sealing member 303 has the plurality of spline-like ribs 303*d*, as the driving force receiving portions, which are located at the base of projecting cylindrical portion 303*c*. The sealing member 303 also has the sealing member securing lip 303*e*, which is located at the end of the protecting cylindrical portion 303*c*, and the sealing member securing groove 303*j*, which is located next to the sealing member securing lip 303*e*. Further, the sealing member 303 has the coupling hole 303*a* as the driving force transmitting portion, which extends through the center portions of the sealing portion 303*b*, from the container main structure side to the sealing member securing lip side. The securing lip side of the coupling hole 303*a* is not open. Therefore, a certain amount of toner, which enters the coupling hole 303*a* as the sealing portion 303*b* is fitted into the toner outlet 301*a*, does leak through the sealing member 303. In other words, fitting the sealing member 303 into the toner outlet 301*a* of the toner supply container 301 completely seals the toner supply container 301.

In this embodiment, the sealing member 303 is given four functions, which are the function of sealing the toner outlet 301*a*, the function of receiving the rotational driving force transmitted from the apparatus main assembly 100, the function of transmitting the rotational driving force to the conveying member 303, and the function of engaging with the sealing member securing member 6 provided on the apparatus main assembly 100 side to open or close the toner outlet 301*a*. Therefore, the driving force which the sealing member 303 receives from the apparatus main assembly 100 can be transmitted to the shaft portion 302A through the bladeless portion 302*c* of the shaft portion 302A of the conveying member 302, to rotate the conveying member 302.

Figure 11:
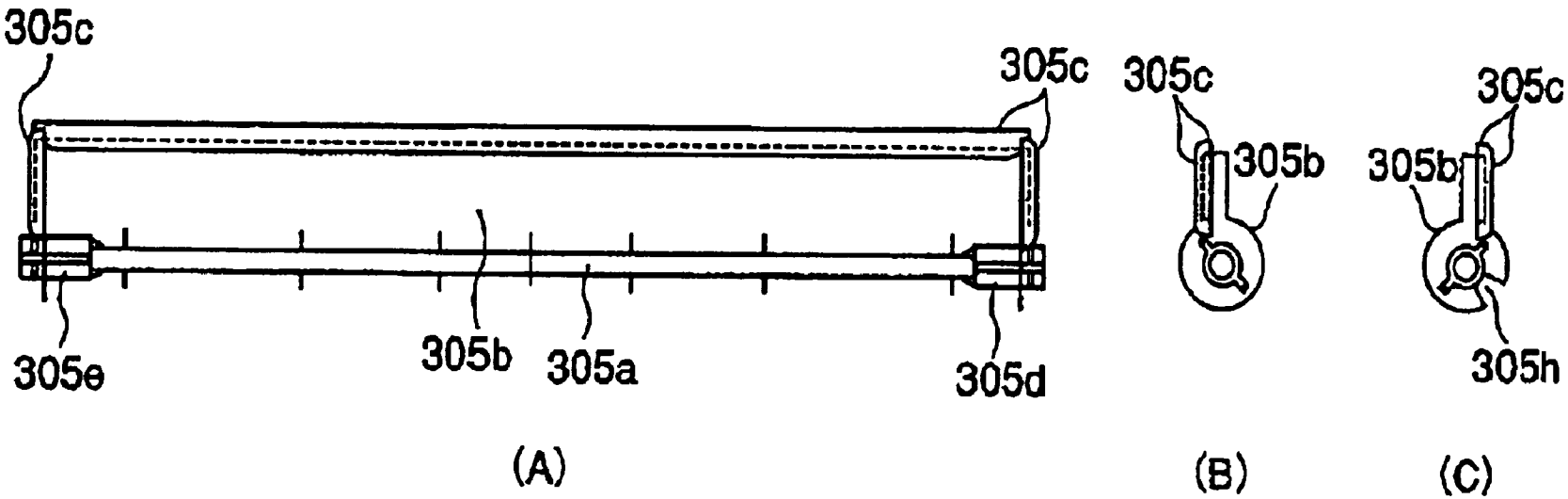
FIGS. 11(A), 11(B), and 11(C) are front view, left side view, and right side view, correspondingly, of the stirring member in accordance with the present invention.
Figure 12:
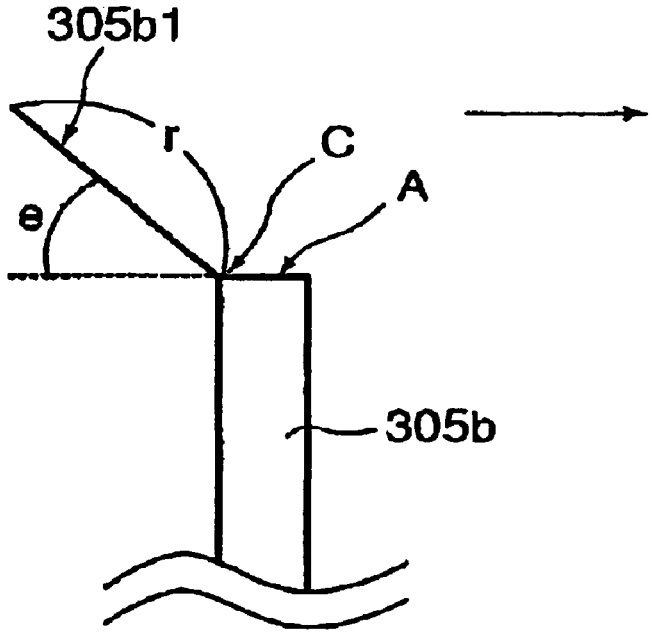
FIG. 12 is an enlarged side view of the rigid blade portion.
Figure 13:
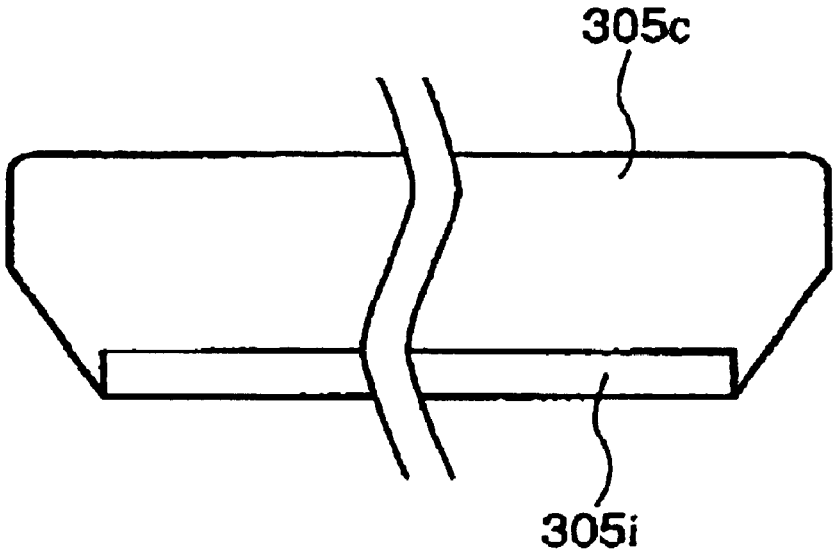
FIG. 13 is an enlarged view of the flexible blade portion

Next, the stirring member 305 will be described. FIG. 11(A) is a front view of the stirring member 305. FIGS. 11(B) and 11(C) are left and right side views of the stirring member 305. As shown in FIG. 11, the stirring member 305 has a shaft portion 305*a*, a rigid blade portion 305*b*, and a flexible blade portion 305*c*. FIG. 12 is an enlarged side view of the rigid blade portion 305*b*, and FIG. 13 is an enlarged view of the flexible blade portion 305*c*. The shaft portion 305*a* is manufactured of plastic relatively high in rigidity, with the use of injection molding. The rigid blade portion 305*b* is formed of metallic material such as stainless steel, or extremely rigid nonmetallic material, whereas the flexible blade portion 305*c* is formed of such material as plastic film or sheet, elastomer sheet, or the like, which is relative low in rigidity. In this embodiment, the flexible blade portion 305*c* is formed of polyester sheet.

One end 305*d* of the stirring member 305 engages with the above described transmitting member 306, in the bearing portion 301*h* of the toner supply container main structure 301A, whereas the other end 305*e* engages with the stopper 310 (second bearing member), in the second bearing seat portion 301*b*2 of the toner supply container main structure 301A. The shaft portion 305*a* in this embodiment is formed of relatively rigid plastic by injection molding. However, the shaft portion 305*a* may be formed of material other than plastic; for example, metallic material.

For simplicity and convenience, the rigid blade portion 305*b* is desired to be monolithically formed of such material as metal. However, it may be formed of material other than metal, with the use of a method other than the method used in this embodiment; the rigid blade portion 305*b* may be molded in two or more pieces, which are integrated into the monolithic rigid blade portion 305*b* by welding, gluing, or the like means. In this embodiment, it is obtained by pressing an approximately 0.8 mm thick stainless steel plate. The portion of the rigid blade portion 305*b*, by which the rigid blade portion 305*b* is connected to the shaft portion 305*a*, is shaped so that it conforms to the shape of the shaft portion 305*a* to receive the driving force from the shaft portion 305*a*. Thus, the rigid blade portion 305*b* rotates with the shaft portion 305*a*, stirring the toner within the container, as the shaft portion 305*a* rotates.

Providing one end of the rigid blade portion 305*b* with a notch 305*h* as shown in FIG. 11 makes it easier to assemble the toner supply container 301. Basically, the rigid blade portion 305*b* is a piece of flat plate virtually parallel to the rotational axis of the shaft portion 305*a*, except that its peripheral portion, with respect to the rotational axis of the shaft portion 305*a*, is bent in the downstream direction in terms of the rotational direction of the stirring-member 305, diagonally facing the internal surface of the toner supply container main structure 301A. The width r of this bent peripheral portion, or the bent portion 305*b*1 in FIG. 12, is desired to be 2 mm–8 mm, and the angle θ by which the peripheral portion was bent is desired to be 30°–50°. Preferably, the width r of the bent portion 305*b*1 is 3 mm–5 mm, and the angle θ is approximately 45°.

In this embodiment, the width r of the bent portion 305*b*1 is approximately 5 mm, and the angle θ is approximately 45°. The distance from the rotational axis of the stirring member 305 to the peripheral edge of the rigid blade portion 305*b* has only to be determined in accordance with the size of the container main structure 301A. However, it is desired to be in a range of 70–95% of the internal diameter of the container main structure 301A. In this embodiment, it is approximately 39.4 mm (89%) since the internal diameter of the container main structure 301A is approximately 44.5 mm.

The flexible blade portion 305*c* is formed of such material as plastic film or sheet, elastomer sheet, or the like, which is relatively low in rigidity. Its thickness is desired to be in a range of 50 μm–500 μm. Preferably, it is in a range of 100 μm–300 μm. In this embodiment, a polyester sheet with a thickness of approximately 100 μm was used.

The length of the above described flexible blade portion 305*c* matches that of the bent portion 305*b*1 of the rigid blade portion 305*b*, and is pasted to the rigid blade portion 305*b* so that its edge portion opposite to the edge portion by which it is pasted to the rigid blade portion 305*b* remains in contact with the internal surface of the container main structure 301A. The flexible blade portion 305*c* rotates with the rigid blade portion 305*b* while scraping down the toner on the internal surface of the container main structure 301A.

Making the dimension of the flexible blade portion 305*c* in terms of the rotational radius of the stirring member 305 greater by approximately 0.5 mm–10 mm than the distance from the peripheral edge of the rigid blade portion 305*b* to the internal surface of the container main structure 301A makes it possible to enhance the above described effect of the flexible blade portion 305*c*.

In this embodiment, the above described dimension of the flexible blade portion 305*c* was made approximately 6 mm longer than the above described distance between the rigid blade portion 305*b* and the internal surface of the container main structure 301A. Also in this embodiment, the flexible blade portion 305*c* was pasted to the bent portion 305*b* of the rigid blade portion 305*b*, with the use of double-sided adhesive tape 305*i* (DIC#8800CH), as shown in FIG. 13. However, the flexible blade portion 305*c* may be attached to the rigid blade portion 305*b* with the use of one of the well known means other than the double-sided adhesive tape; for example, riveting, crimping, or the like.

Figure 14:
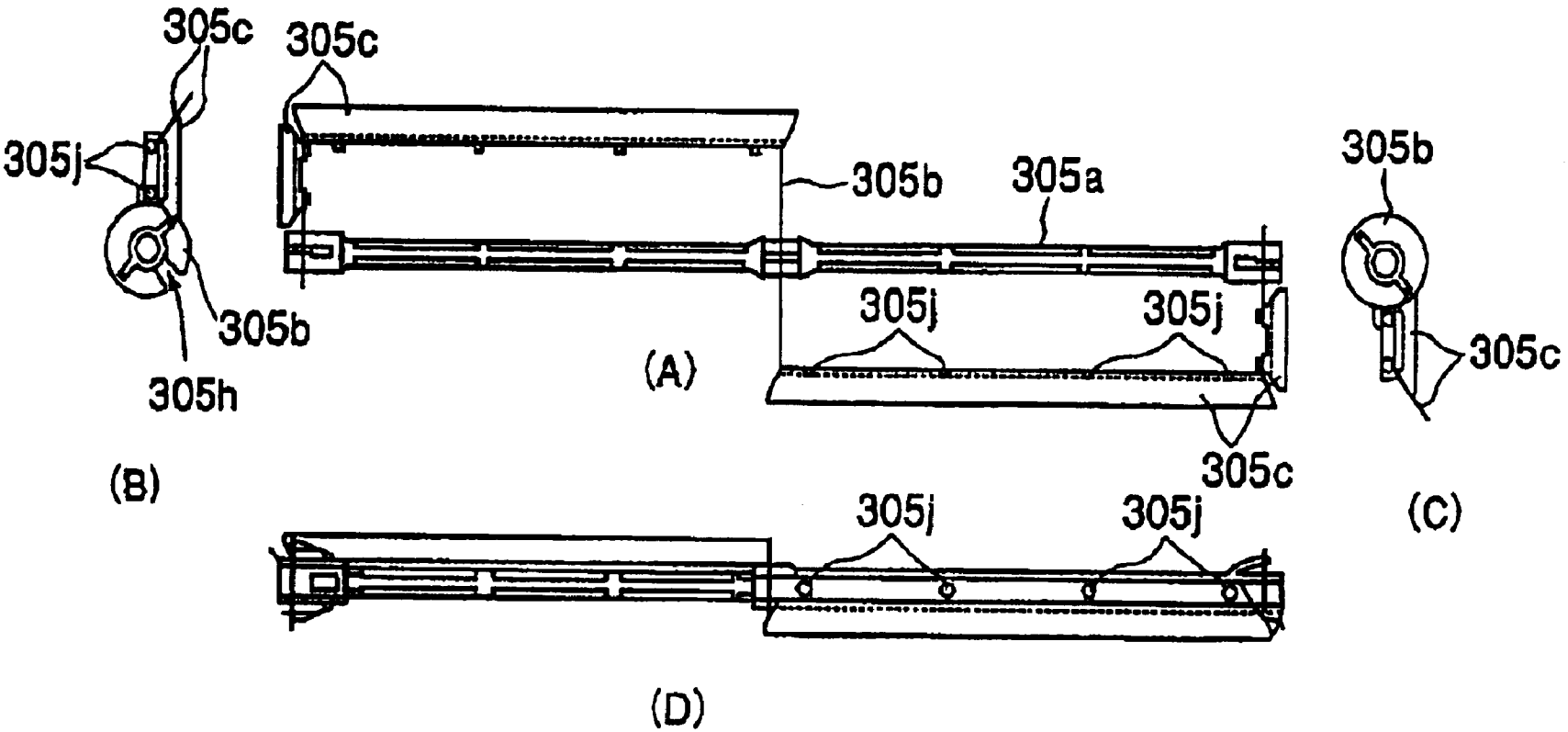
FIGS. 14(A), 14(B), 14(C), and 14(D), are front view, left side view, and bottom view, correspondingly, of the stirring member in another embodiment of the present invention.

Further, the rigid blade portion 305*b* may be divided at the middle in terms of its lengthwise direction, into two equal halves, so that two halves can be attached to the shaft portion 305*a* with the presence of a difference of 180° in rotational phase between the two halves; the two halves may be placed in zig-zag, as shown in FIG. 14. The number of pieces into which the rigid blade portion 305*b* is divided has only to be determined according to the shape and length of the container main structure 301A; the rigid blade portion 305*b* may be divided into three, four, or more pieces. Further, the rigid blade portion 305*b* may be structured so that its rotational phase continually changes; in other words, it may be given a spiral shape. Providing the lengthwise ends and approximate center portion of the shaft portion 305*a*, to which the rigid blade portion 305*b* is attached, with a notch 305*h* improves the efficiency with which the toner supply container 301 is assembled In this embodiment, in order to reduce the toner resistance by reducing the size of the projected area of the rigid blade portion 305*b* in terms of the rotational direction, the above described width of the bent portion 305*b*1 of the rigid blade portion 305*b* was made to be approximately 3 mm. The width and angle of the bent portion 305*b*1 is desired to be 2–8 mm, and 30–50°, preferably, 3–5 mm and approximately 45°, respectively.

Regarding the method for attaching the flexible blade portion 305*c* to the rigid blade portion 305*b*, the former may be riveted to the latter with the use of aluminum rivets 305*j*. In the case of this method, it is possible that the presence of even slight misalignment in terms of rivet hole between the flexible and rigid blade portions 305*c* and 305*b* will make the flexible blade portion 305*c* wavy. In order to prevent such a problem, it is recommendable to provide the flexible blade portion 305*c* with perforations or half-cut, across the area corresponding to the bent portion C of the rigid blade portion 305*b*. Regarding the pasting means, one of the well known methods other than riveting may be used; for example, double-sided adhesive tape.

Next, the method for assembling the toner supply container 301 will be described.

As for a method for assembling the toner supply container 301, first, conveying member 302 is inserted into the bottom portion of the bottom frame 301K, from above. Next, the toner seal 309 is inserted into the first bearing seat portion 301*b*1, and the bearing member 308 is fitted around the other end portion 302*b* of the conveying member 302. Then, the toner outlet opening 301*g* is sealed with the sealing member 303. Next, the stirring member 305 is inserted from above. Then, the toner seal 309 is inserted into the container main structure 301A, and the second bearing member 310 and transmitting member 306 are engaged with the lengthwise ends of the stirring member 305, one for one. Thereafter, the top and bottom frames 301J and 301K are joined with each other by vibration welding.

Next, a predetermined amount of toner is filled into the container main structure 301A through the toner inlet 301*i* of the container main structure 301A, and the toner inlet 301*i* is sealed with a sealing member 311, completing the toner supply container 301. As is evident from the above description, the assembly of the toner supply container 301 is very simple, requiring only a small number of assembly steps.

Incidentally, the toner may be filled through the toner outlet opening 301*g*.

When the toner outlet 301*a* is unsealed by the toner supply container sealing/unsealing means, which was described previously, a certain amount of force is applied to the toner outlet 301*a* and latching/aligning portion 301*c* of the container main structure 301A. However, the container main structure 301A is prevented from being lifted by this force from the apparatus main assembly 100, since the latching/aligning portion 301*c* on the external surface of the bottom portion of the container main structure 301A is on the opposite side from the side where the toner outlet 301*a* is present, in terms of the lengthwise direction of the container mains structure. Moreover, should the container main structure 301A be lifted, the top wall 301E would come into contact with the top wall 100*d* (FIG. 15) of the apparatus main assembly 100, preventing the container main structure 301A from being lifted upward more than a predetermined distance.

Figure 15:
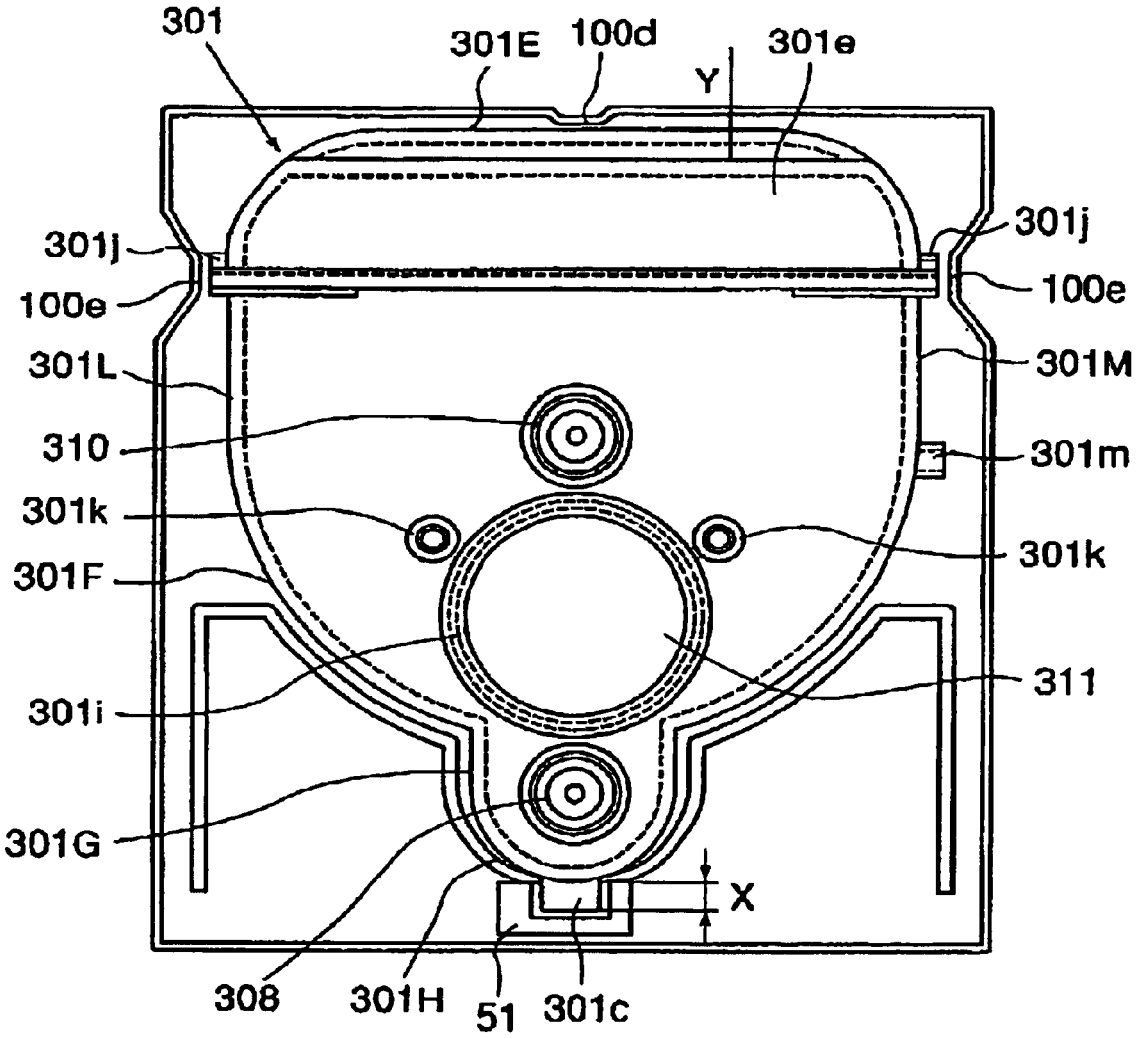
FIG. 15 is a side view of the toner supply container, which has been mounted in the main assembly of an image forming apparatus.

Referring to FIG. 15, the latching/aligning projection 301*c* and toner outlet opening 301*g* of the toner supply container 301 are desired to be in alignment with each other in terms of the direction in which the toner supply container 301 is slid. Such a structural arrangement prevents the occurrence of the left- or rightward moment (with reference to FIG. 15) to the toner supply container 301, with respect to the sliding direction of the toner supply container 301. Should the left- or rightward moment occur to the toner supply container 301, a plurality of ribs 301*j*, as side wall regulating portions, provided on the side walls 301L and 301M, that is, the walls parallel to the stirring member 305, come into contact with the side walls 100*e* of the apparatus main assembly 100, preventing the container main structure 301A from moving sideways more than a predetermined distance.

In order to prevent the toner supply container 301 from being disengaged upward from the toner supply container tray 50 when the toner supply container 301 is slid, the latching/aligning projection 301*c* of the toner supply container 301 is made tall enough for the height X (FIG. 15), that is, the margin, by which the latching/aligning projection 301*c* engages with the chucking member 51 to be greater than the clearance Y (FIG. 15) between the top wall 301E of the toner supply container 301 and the top wall 100*d* of the apparatus main assembly 100.

Referring to FIG. 15, in order to minimize the rattling of the toner supply container 301, the left and right ribs 301*j* of the toner supply container 301 are desired to be provided on the top portion of the toner supply container 301. In this embodiment, the left and right ribs 301*j* are positioned above the vertical center portion of the toner supply container 301, with the provision of a proper amount of clearance between them and the side walls 100*e* of the apparatus main assembly 100.

Next, the driving mechanism for the toner supply container 301 in this embodiment will be described.

Referring to FIG. 6, when mounting the toner supply container 301, the coupling portion 303*c* of the sealing member 303 engages into the first coupling member 304 on the apparatus main assembly 100 side. The first coupling member 304 is a member for transmitting to the sealing member 303, the driving force from the driving apparatus (unshown) provided on the apparatus main assembly 100 side.

Figure 16:
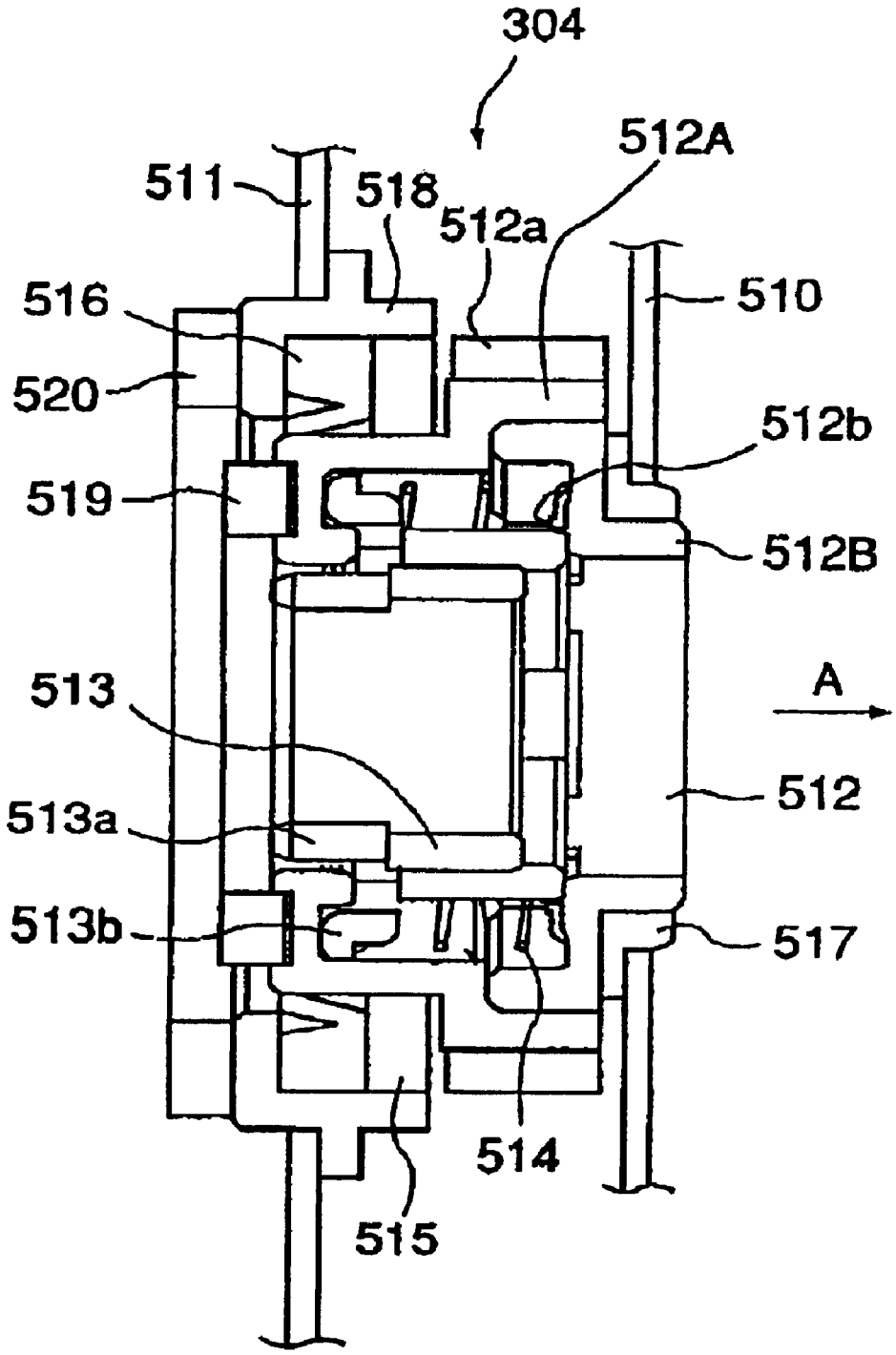
FIG. 16 is a detailed vertical sectional view of a first coupling member.

FIG. 16 is a detailed view of the first coupling member 304.

A referential code 512 designates a gear assembly, which has teeth on its peripheral surface 512*a*. The gear assembly 512 essentially comprises two portions: gear portion 512A and cover portion 512B, which have been securely fixed to each other by snap fitting, gluing, or the like method. The gear assembly 512 is provided with a pressure generating means 514 and a moving means 513. The pressure generating means 514 is a compression coil spring, and is placed in contact with the portion 512*b* of the gear assembly 512, and the portion 513*b* of the moving member 513, being therefore compressed.

Figure 17:
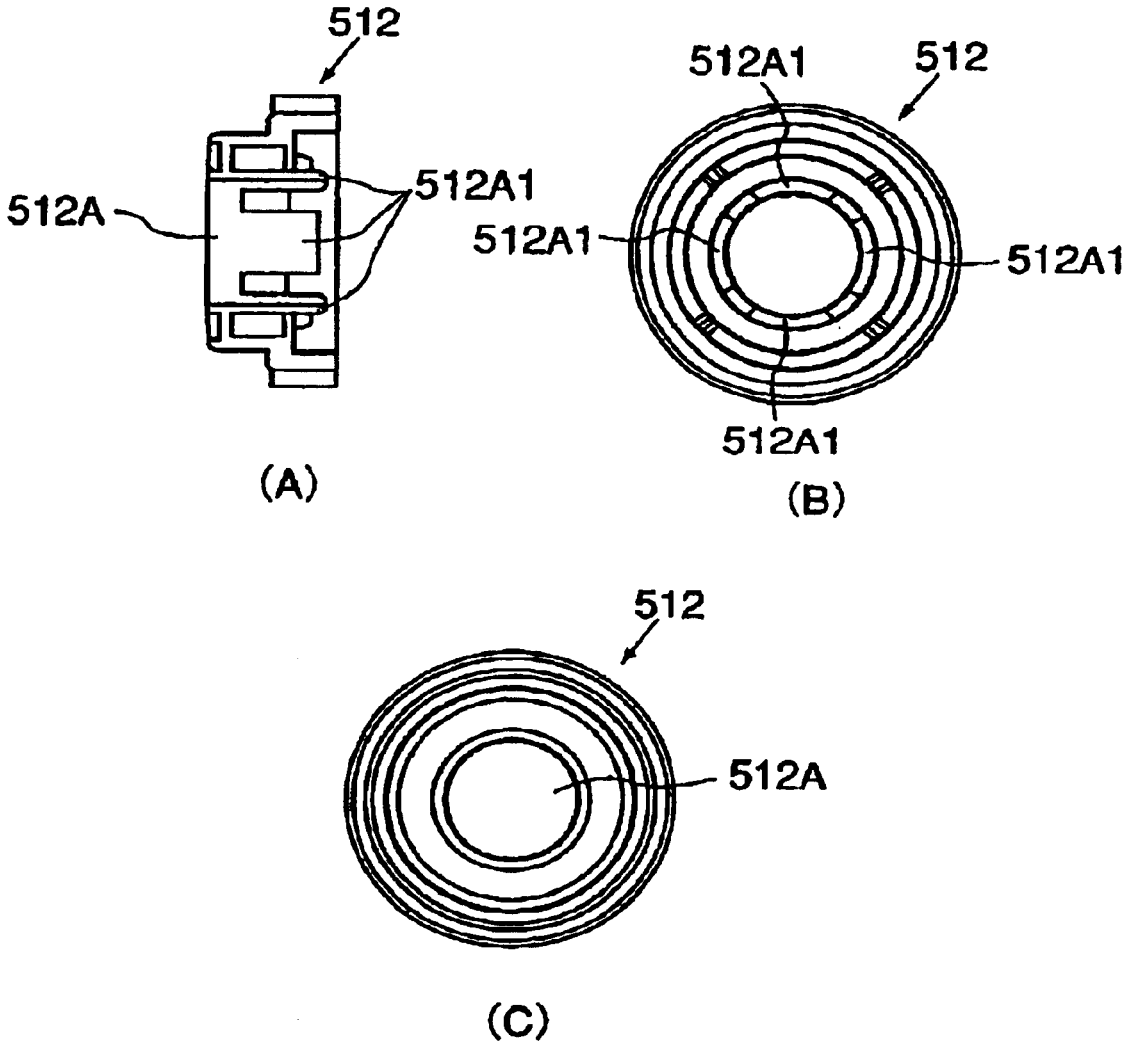
FIGS. 17(A), 17(B), ad 17(C) are detailed sectional view, parallel to the axial line, of the gear assembly, detailed right side view of the gear assembly in FIG. 17(A), and detailed left side view of the gear assembly in FIG. 17(A), correspondingly.
Figure 18:
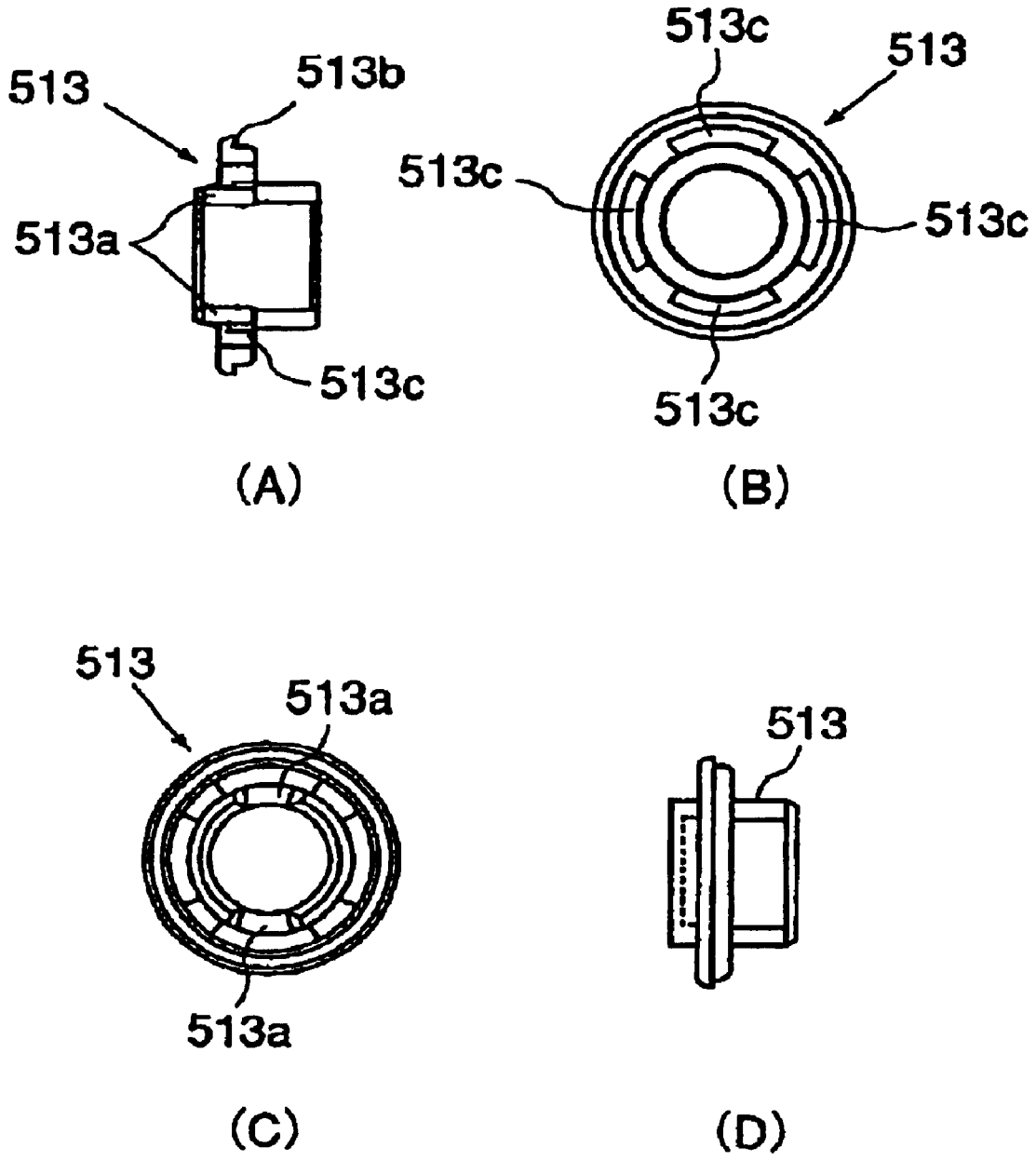
FIGS. 18(A), 18(B), 18(C), and 18(D) are detailed vertical sectional view, parallel to the axial line, of the moving member in accordance with the present invention, detailed plan view of the moving member in FIG. 18(A) as seen from the right side, detailed plan view of the moving member in FIG. 18(A) as seen from the left side, and detailed side view of the moving member in FIG. 18(A), parallel to its axial line.

FIG. 17 is a detailed view of the gear assembly 512. FIG. 17(A) is a sectional view of the gear assembly 512, parallel to its axial line, and FIGS. 17(B) and 17(C) are plan views of the gear assembly 512 FIG. 18 is a detailed view of the moving member 513. FIG. 18(A) is a sectional view of the gear assembly 512, parallel to its axial line. FIGS. 18(B) and 18(C) are plan views of the gear assembly 512, perpendicular to its axial line FIG. 18(D) is an external view of the gear assembly 512, parallel to its axial line.

Referring to FIG. 17, the gear portion 512A is provided with four guiding ribs 512A1 for guiding the moving member 513 in its axial direction as the moving member 513 slides in the gear assembly 512. The four guiding ribs 512A1 are evenly distributed in the circumferential direction of the gear portion 512A. Referring to FIG. 18, the moving member 513 is provided with four guiding holes 513*c* for guiding the moving member 513 in its axial direction as the moving member 513 slides in the gear assembly 512. They are evenly distributed in the circumferential direction of the moving member 513. The guiding ribs 512A1 fit into the guiding holes 513*c*, one for one, making it possible to guide the moving member 513 in its axial direction as the gear assembly 512 slides in the gear assembly 512.

The portions of the moving member 513 designated by a referential code 513*a* are the driving force transmitting portions, which are in the form of a groove. As the toner supply container 301 is mounted into the apparatus main assembly 100, the spline-like ribs 303*d* of the sealing member 303 engage one for one into the driving force transmitting portions 513*a*, making it possible for the rotational driving force to be transmitted to the sealing member 303.

Referring to FIG. 16, designated by referential codes 515 and 517 are bearings for rotational supporting the gear assembly 512, and a referential code 516 designates a toner seal. The toner seal 516 prevents the toner discharged from the toner outlet opening 301*g*, from entering the bearings 515 and 517, preventing thereby the gear assembly 512 from being locked up by the toner. A referential code 519 designates a gear seal. As the toner supply container 301 is mounted into the apparatus main assembly 100, the gear seal 519 is pressed against the sealing member 303, preventing the toner discharged from the toner outlet opening 301*g*, from entering the gear assembly 512. Referential codes 510 and 511 designate side plates for supporting the first coupling member 304. A referential code 518 designates a bearing holder, which is for holding the bearing 515 and toner seal 516, and is secured to the side plate 511 with the screws, glue, or the like means. A referential code 520 designates a holder seal for preventing toner from leaking from between a holder 5, shown in FIG. 7, and the bearing holder 518.

The gear seal 519 and holder seal 520 are secured to the corresponding gears 520 and bearing holder 518, with the use of double-sided adhesive tape or the like. Their material is an elastic material such as foamable urethane or the like.

Next, the operation of the first coupling member 304 will be described. With the provision of the above described structure, the moving member 513 of the coupling member 304 is retractable in the direction indicated by an arrow mark A in FIG. 16. Normally, the moving member 513 is at a location at which the portion 513*b* of the moving member 513 is kept pressed upon the gear portion 512A, by the pressure generating means 514, as shown in FIG. 16. Referring to FIG. 7, as the toner supply container 301 is inserted into the apparatus main assembly 100, the sealing member 303 moves in the direction to enter the coupling member 304. During this movement of the sealing member 303, when the ribs 303*d* of the sealing member 303 are synchronous in rotational phase with the driving force transmitting portion 513*a* of the moving member 513, the sealing member 303 enters the coupling member 304. Then, as the gear assembly 512 is driven by an unshown driving force source on the apparatus main assembly 100 side, the moving (driving) member 513 is rotated, and the sealing member 303 is rotated through the driving force transmitting portion 513*a*. On the other hand, when the ribs 303*d* of the sealing member 303 are not synchronous in rotational phase with the driving force transmitting portion 513*a* of the moving member 513, the moving member 513 is pushed by ribs 303*d* of the sealing member 303, in the direction of the arrow mark A in FIG. 16. Then, as the gear assembly 512 and moving member 513 are rotated by the driving portion on the apparatus main assembly 100 side, the moving member 513 rotates without engaging with the ribs 303*d* of the sealing member 303, until the ribs 303*d* of the sealing member 303 become synchronized in rotational phase with the driving force transmitting portion 513*a* of the moving member 513. Then as soon as the synchronization of the rotational phase occurs, the spline-like ribs 303*d* of the sealing never 303 are slid by the pressure generating means 514 into the driving force transmitting portions 513*a* of the moving member 513, until the state shown in FIG. 16 is realized. As a result, the driving force is transmitted to the sealing member 303.

Figure 19:
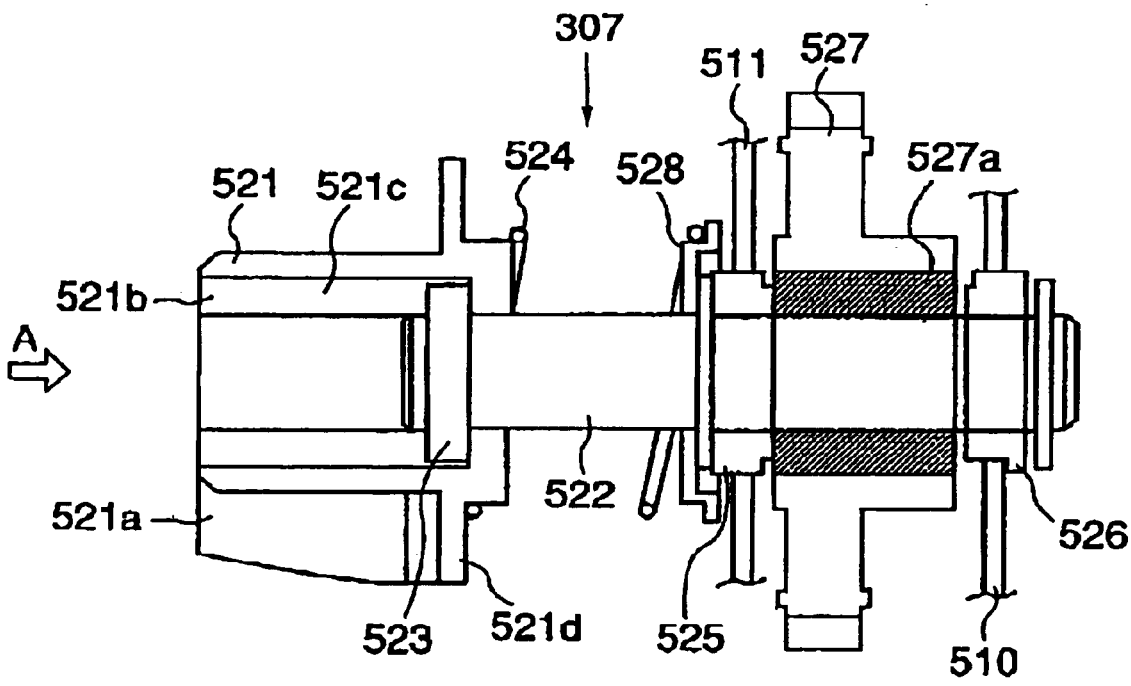
FIG. 19 is a detailed vertical sectional view of a second coupling member.
Figure 20:
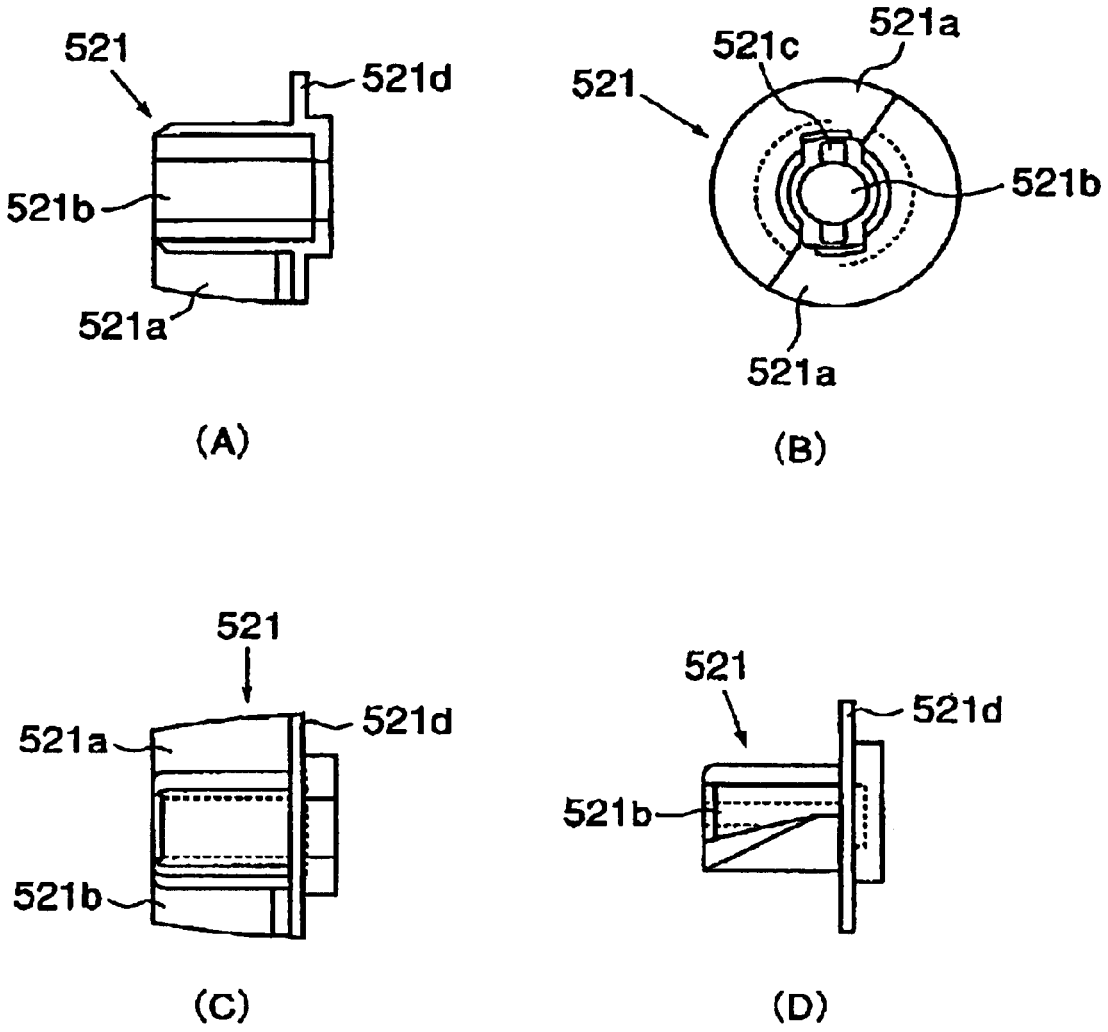
FIGS. 20(A), 20(B), 20(C), and 20(D) are vertical sectional view, parallel to the axial line, plan view, side view, and top view, correspondingly, of the driving force transmission claws.
Figure 21:
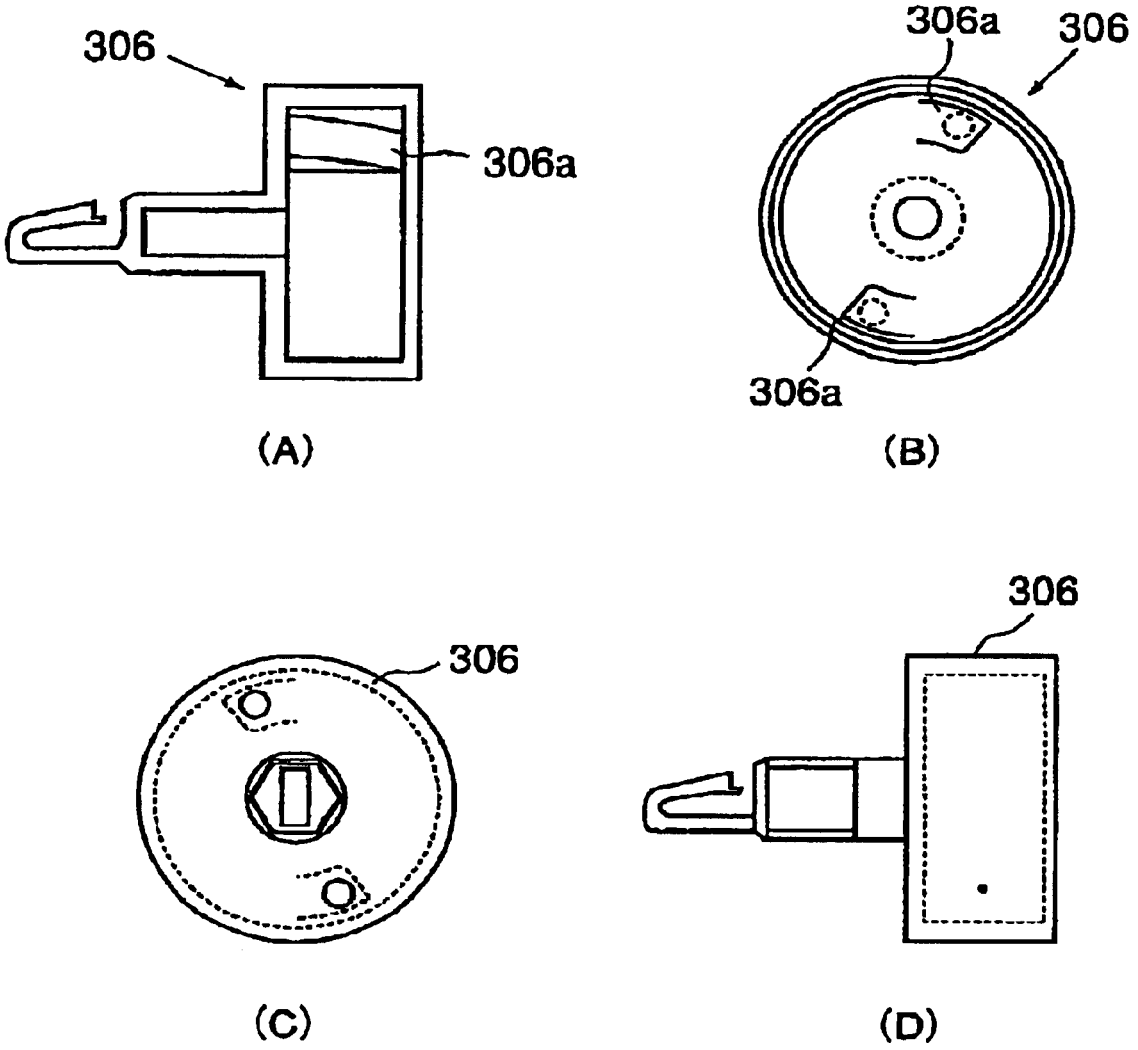
FIG. 21(A), 21(B), 21(C), and 21(D) are vertical sectional view, parallel to the axial line, plan view as seen from the right side, plan view as seen from the left side, and side view parallel to the axial line, correspondingly, of the driving force transmitting member.

FIG. 19 is a detailed drawing of the second coupling member 307. In the drawing, a referential code 521 designates a driving force transmitting claw. FIG. 20(A) is a sectional view of the driving force transmitting member 521, parallel to its axial line, and FIG. 20(B) is a sectional view of the driving force transmitting claw 521, perpendicular to its axial line. FIG. 20(C) is an external view of the driving force transmitting claw 521, as seen from the horizontal direction perpendicular to its axial line, and FIG. 20(D) is an external view of the driving force transmitting claw 521 as seen from above. In FIG. 20, a referential code 521*b* designates an actual claw portion 521*a*; 521*b*, a guiding portion: 521*c*, a parallel pin groove; and a referential code 521*d* designates a spring seat. FIG. 21 is a detailed drawing of the transmitting member 306 in FIG. 9: (A) is a sectional view parallel to the axial line; (B), a plan view as seen from the direction of the axial line; (C), a plan view as seen from the direction of the axial line; (D), a side view as seen from the direction perpendicular to its axial line. In FIG. 21, a referential code 306*a* designates a driving force transmitting portion.

Referring to FIG. 19, designated by a referential code 522 is a drive shaft, which is rotationally supported by the side plates 510 and 511, with the interposition of bearings 525 and 526. The drive shaft 522 is fitted with a one-way gear 527, with the interposition of a one-way clutch 527*a* (component for transmitting rotational driving force only in a predetermined rotational direction), which is an integral part of the one-way gear 527.

The driving force transmitting claw 521 is allowed to slide on the drive shaft 522, by the engagement between the guiding portion 521*b* and drive shaft 522. The parallel pin 523 is put through a through hole of the drive shaft 522, the axial line of which perpendicularly intersects with the axial line of the drive shaft 522. The parallel pin 523 fits in the parallel pin groove 521*c*, transmitting the rotational force of the drive shaft 522 to the driving force transmitting claw 521. A referential code 524 designates a pressure generating means, which is a compression spring. The pressure generating means 524 is in contact with the spring seat 528 and the spring seat 521*d* of the driving force transmitting claw 521, being compressed between the two spring seats.

Next, the operation of the second coupling member 307 will be described. With the provision of the above described structure, the driving force transmitting claw of the second coupling member 307 is allowed to moved in the direction indicated by an arrow mark A in FIG. 19. Normally, it is kept at the location illustrated in FIG. 19, by the pressure generated by the pressure generating means 524. As the toner supply container 301 is inserted into the apparatus main assembly 100, the transmitting member 306 moves onto the second coupling member 307. However, when the rotational phases of the transmitting claw portions 306*a* of the transmitting member 306 and the claw portions 521*a* of the driving force transmitting claw 521 are such that as the toner supply container 301 is inserted into the apparatus main assembly 100, the transmitting claw portions 306*a* collide with the claws 521*a*, the claw portions 521*a* of the driving force transmitting claw 521 are rotated by the transmitting claw portion 306*a* of the transmitting member 306. During this operational stage, the drive shaft 522 also rotates as the transmitting member 306 rotates. However, the one-way clutch portion 527*a* of the one-way gear 527 does not allow the engagement between the one-way gear 527 and drive shaft 306, preventing the driving force transmitting claw 521 and transmitting member 306 from interfering with each other when the toner supply container 301 is mounted into the apparatus main assembly 100.

As the state of the toner supply container 301 is changed from the one shown in FIG. 7 to the one shown in FIG. 6, the transmitting member 306 retracts leftward. However, the driving force transmitting claw 521 is made to follow the pressure generating means 524. Therefore, the actual transmitting claw portions 306*a* of the transmitting member 306 and the claws portions 521*a* of the driving force transmitting claw 521 remain engaged with each other.

Thus, the rotational driving force from the unshown driving means on the apparatus main assembly 100 is transmitted to the transmitting member 306 by way of the one-way gear 527, and drive shaft 522, driving force transmitting claw 521. As a result, the stirring member 305 rotates.

Next, the toner discharging operation will be described.

When the toner supply container 301 is in the apparatus main assembly 100, the sealing member securing portion 303*e*, or the leading end in terms of the toner supply container inserting direction, of the sealing member 303 remains engaged with the coupling member 6 of the image forming apparatus. Therefore, the sealing member is kept away from the toner outlet opening 301*g*, and the positional relationship between the conveying member 302 and sealing member 303 in terms of their rotational direction remains unchanged.

The sealing member 303 remains engaged with the first coupling member 304 of the apparatus main assembly 100, by the coupling portion 303*c* (driving force receiving portion). The rotational driving force from the driving force source such as a motor (unshown) on the apparatus main assembly 100 side is received by the first coupling member 304 through the driving force transmitting means (unshown) such as a gear train, and then, is transmitted to the sealing member 303, through the engagement between the spline-like ribs 303*d* and the first coupling member 304. The driving force is further transmitted to the conveying member 302 through the engagement of the shaft end portion 302*a* of the conveying member 302 into the square hole 303*a* of the sealing member 303. Similarly, the transmitting member 306 engaged with the end 305*d* of the stirring member 305 is engaged with the second coupling member 307 of the apparatus main assembly 100. The second coupling member 307 of the apparatus main assembly 100 receives rotational driving force from the driving force source (unshown) such as a motor of the apparatus main assembly 100 through a driving force transmitting means (unshown) such as a gear train, and this driving force is transmitted to the stirring member 305 through the engagement between the transmitting claw portions 306*a* of the transmitting member 306 and the second coupling member 307. The rotational velocities of the conveying member 302 and stirring member 305 were set to approximately 52 rpm and approximately 10 rpm, respectively.

The toner within the toner supply container 301 naturally agglomerates while the toner supply container 301 is stored for a long period of time. It also agglomerates due to the vibrations or the like which occur during the transportation of the toner supply container 301. However, as the stirring member 305 rotates, the agglomerated toner in the toner supply container 301 is loosened, and then, is conveyed toward the toner outlet 301*a* by the rotation of the conveying member 302. Then, the toner is discharged from the toner outlet opening 301*g*, and falls into the toner hopper 201*a* of the apparatus main assembly 100.

The toner supply container 301 structured as described above was tested for its toner discharging performance. In the test, the container main structure 301A of the toner supply container 301 was filled up with toner, and the toner was discharged, with the rotational velocities of the stirring member 305 and conveying member 302 set at approximately 10 rpm and approximately 52 rpm, respectively. The amount of large toner particles within the discharged toner was measured with the use of a sieve (75 $\mu$m in mesh size; made of SUS), confirming the absence of large toner particles. The amount of the toner, which remained undischarged within the toner supply container 301 was 20 g, confirming another effect of the present invention, that is, the reduction in the amount of the unusable toner within a toner supply container.

Figure 22:
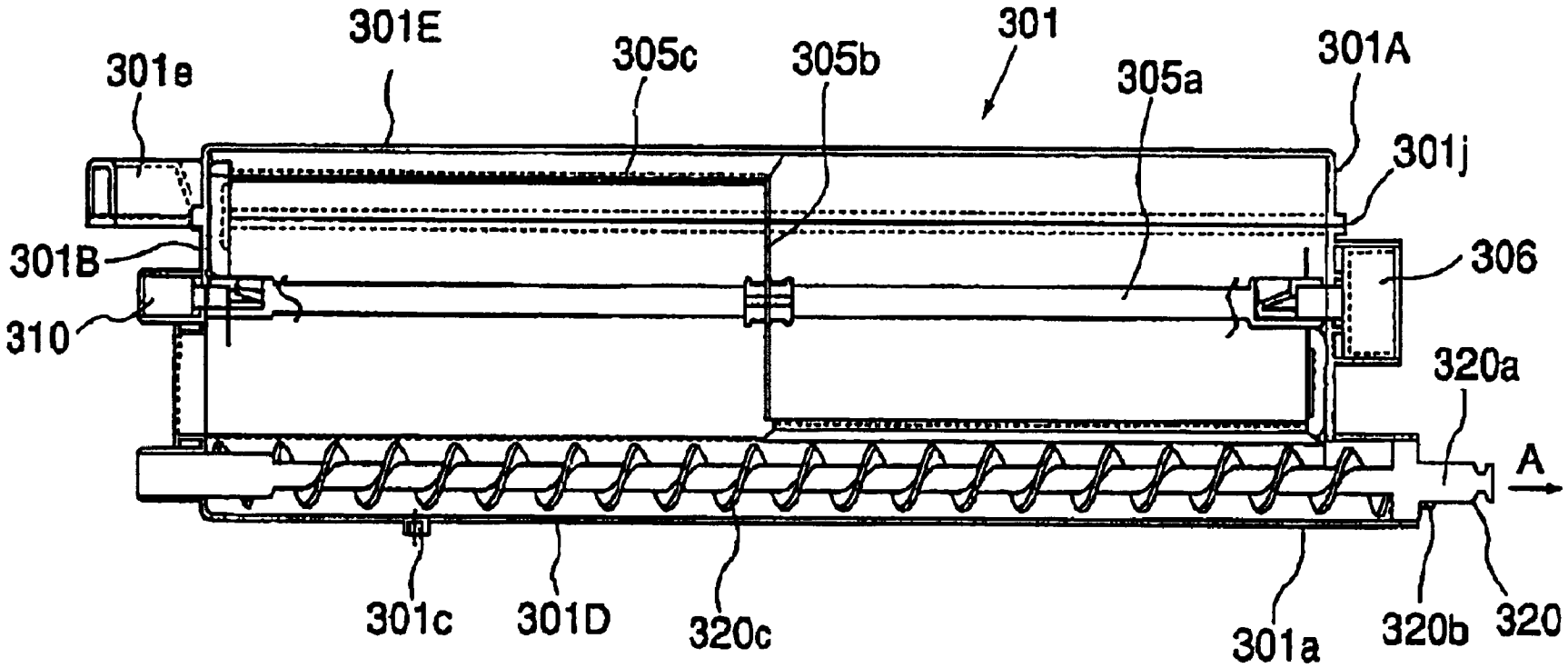
FIG. 22 is a vertical sectional view, parallel to the lengthwise direction, of the toner supply container, in which the sealing member is integral with the conveying member.

Although the toner supply container 301 in this embodiment is structured so that the sealing member 303 is movable relative to the conveying member 302 in their axial direction, the sealing member and conveying member may be formed as the portions of a monolithic multifunctional member as shown in FIG. 22. In FIG. 22, a sealing member 320 comprises a sealing portion 320*a*, a driving force receiving portion 320*b*, and a toner conveying portion 320*c*. It is movable relative to the container main structure in the direction indicated by an arrow mark A in FIG. 22.

Figure 23:
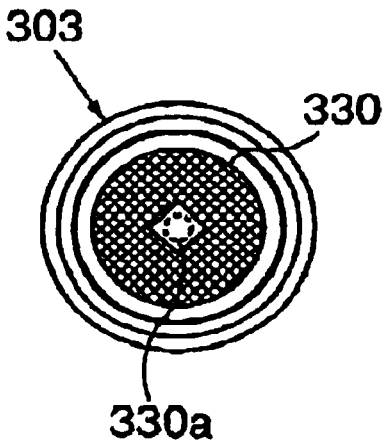
FIGS. 23(A), 23(B), and 23(C) plan view, side view, and vertical sectional view, of the sealing member with a sealing portion integral with the sealing member.
Figure 23:
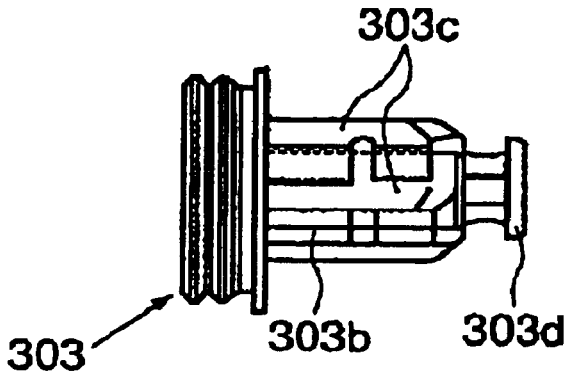
Figure 23:
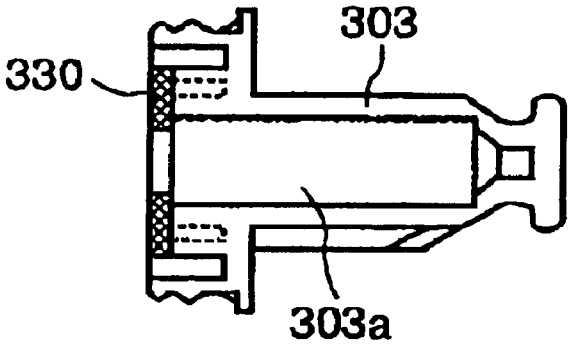

The sealing portion may be formed as an integral portion of the above described driving portion (driving force transmitting portion) of the sealing member 303, as shown in FIG. 23. FIG. 23(A) is a plan view of a sealing member with a sealing portion, perpendicular to the axial line of the sealing member, and FIG. 23(B) is a side view of the sealing member in FIG. 23(A). FIG. 23(B) is a sectional view of the sealing member in FIG. 23(A), parallel to the axial line of the sealing member.

A referential code 330 designates a disklike sealing portion, which has a rectangular hole 330*a*, the shape of which matches the cross section of the shaft end portion 302*a* of the conveying member 302. In this embodiment, the cross section of the hole 330*a* is square as is the shaft end portion 302*a* of the conveying member 302. The sealing portion 303 is on the opposite side of the sealing member 303, with respect to the side which faces the container main structure 301A. It is structured so that the shaft end portion 302*a* of the conveying member 302 can be loosely put through the hole 330*a*.

Figure 24:
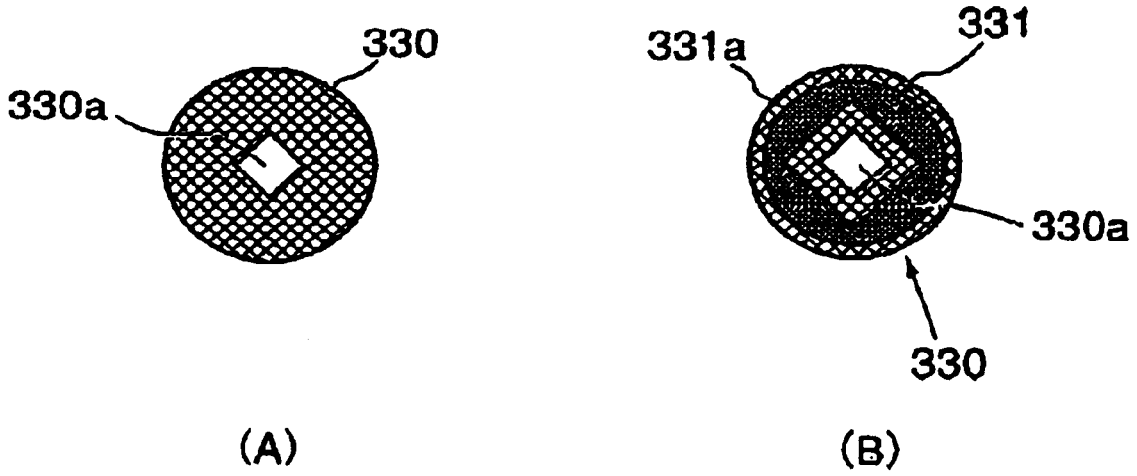
FIGS. 24(A) and 24(B) are plan views of the sealing portion, as seen from the toner supply container main structure side, and sealing member side, respectively.
Figure 25:
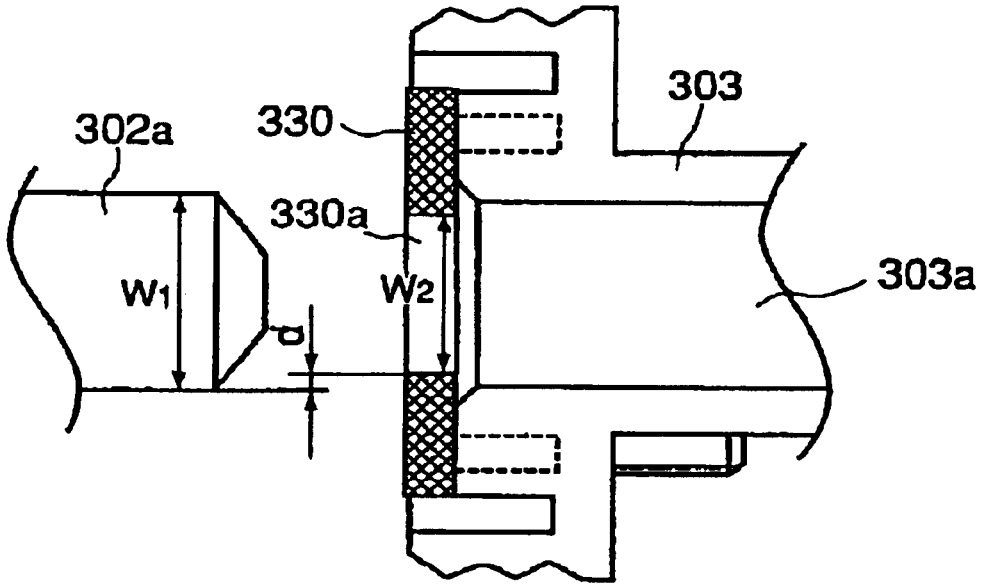
FIG. 25 is an enlarged side view of the conveying member and sealing member.

FIG. 24 is a plan view of the sealing portion 330 in accordance with the present invention. Designated by a referential code 331 in the drawing is a double-sided adhesive tape, which is pasted to the sealing portion 330, on the side which faces the sealing member 303. The double-sided adhesive tape has a hole 331*a*, which is structured so that the shaft end portion 302*a* can be loosely put through the hole 330*a*. Further, in order to prevent the double-sided adhesive tape 331 from contacting the shaft end portion 302*a*, the hole 331*a* is made greater in size, in terms of cross section, than the hole 330*a*. Although the sealing portion 330 in this embodiment is secured to the sealing member 303 with the use of the double-sided adhesive tape, securing means other than the double-sided adhesive may be used. For example, the sealing portion 330 may be secured to the sealing member 303 with the use of two color injection molding or insert molding. FIG. 25 is an enlarged side view of the conveying member 302 and sealing member 303 in accordance with the present invention. The size (W2) of cross section of the hole 330*a* is made smaller than the size (W1=6 mm) of the cross section of the shaft end portion 302*a*. Concretely, the difference (d) between W1 and W2 is desired to be 0.5 mm–2 mm. In this embodiment, W2=5 mm, and d=W1−W2=1 mm. In consideration of the sealing performance and assembly efficiency, the thickness of the sealing portion 330 is desired to be 0.5 mm 5 mm, preferably, 1 mm–3 mm. In this embodiment, the thickness of the sealing portion 330 was made to be approximately 2 mm. Also in consideration of the sealing performance and assembly efficiency, the material for the sealing portion 330 is desired to be soft and elastic. In this embodiment, foamable polyurethane was used to form a sealing portion 330 which was 20°–70° in hardness, no more than 4% in permanent compressive strain, no more than 0.8 in coefficient of friction, 60–300 $\mu$m in cell size, and 0.2–0.5 in specific gravity.

The toner supply container 301 structured as described above was filled with toner, and was tested for toner discharging performance, with the rotational velocity of the conveying member set to 25 rpm, while repeatedly sealing or unsealing the toner outlet 301*a* with the sealing member 303. Even after the toner outlet 301*a* was repeatedly sealed and unsealed 200 times, the toner did not enter deep into the sealing member 303 past the hole 303*a*; the toner was prevented from leaking.

Further, silicon rubber, urethane rubber; thermoplastic elastomer, for example, polystyrene, polyolefin, polyurethane, polyester, or polyamide; and sponge, were used to form sealing portions 330, and the sealing members 303 were subjected to the same tests as the above described one. The test results were the same as those obtained when foamable material such as foamable polyurethane was used as the material for the sealing portion 330.

Next, a method for cleaning a toner supply container in accordance with the present invention, a method for remanufacturing a toner supply container in accordance with the present invention, and a remanufactured toner supply container in accordance with the present invention, will be described. The toner supply containers in the following description are identical to those described above.

Figure 26:
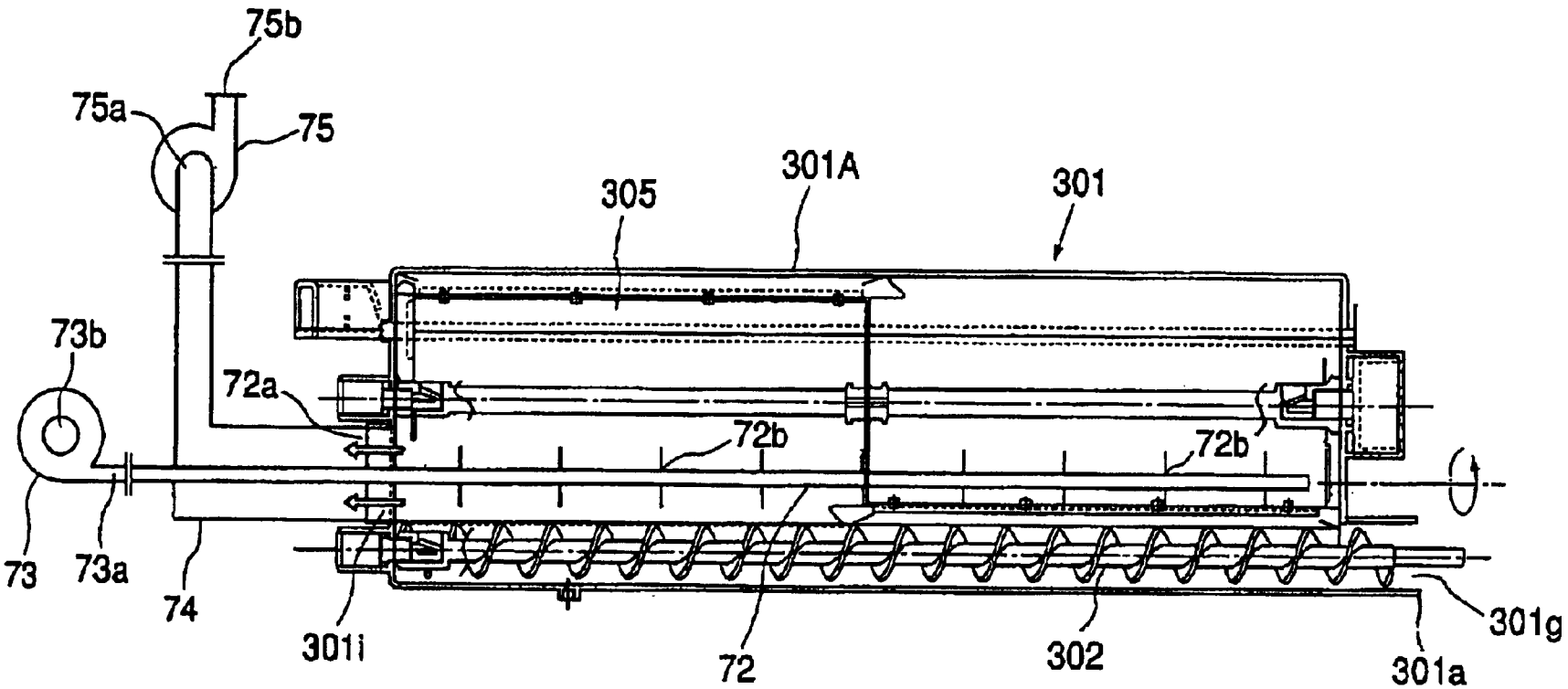
FIG. 26 is a vertical sectional view, parallel to the lengthwise direction, of the toner supply container in the first embodiment of the present invention.

FIG. 26 is a vertical sectional view of a toner supply container, parallel to the axial line of the container, to which a toner supply container cleaning method in accordance with the present invention is applicable. As shown in FIG. 26, after the removal of the two sealing members 303 and 311 from the toner supply container 301, the toner outlet 301*a* and toner inlet 301*i* are both open. The toner supply container 301 can be effectively cleaned by blowing air through either the opening of the toner outlet 301*a* or the opening of the toner inlet 301*i*, while suctioning the air through the same opening; the foreign substances adhering to the internal surface of the toner supply container 301 can be effectively removed. During this cleaning step, in order to prevent toner particles from scattering out of the toner supply container 301, and also to enhance the cleaning efficiency, the amount by which air is suctioned is made greater than the amount by which air is blown into the toner supply container 301. In this embodiment, the toner inlet is greater in diameter than the toner outlet. Therefore, the opening of the toner inlet was used as the opening through which air is blown into, and suctioned out of, the toner supply container.

There is a possibility that setting the amount by which air is suctioned, to be greater than the amount by which air is blown into the toner supply container, will make the internal pressure of the toner supply container lower than the ambient pressure, resulting in the deformation of the container itself. Thus, in this embodiment, the other opening, that is, the opening of the toner outlet, was kept open, allowing the ambient air to naturally enter the toner supply container through the opening of the toner outlet, to maintain a balance between the internal and ambient pressures of the toner supply container.

Incidentally, when cleaning the interior of the toner supply container, the amount of the ambient air which enters the toner supply container through the aforementioned other opening may be adjusted by fitting the other opening with an air flow adjustment cap which has a hole with a predetermined size, instead of leaving the other opening wide open. With the provision of this arrangement, it is possible to keep the internal pressure of the toner supply container negative, relative to the ambient pressure, to such a degree that the interior of the toner supply container is efficiently cleaned by suctioning the foreign substances such as deteriorated toner particles, without deforming the toner supply container.

Air may be blown into the toner supply container through the opening of the toner inlet 301*i*, that is, one of the openings of the toner supply container, from the nozzle of an air gun. It is desired that the air nozzle is inserted into the toner supply container through the toner inlet 301*i*. In this embodiment, the air nozzle was provided with 32 air blowing orifices 72*b*, which were divided into eight sets, each of which comprised four air blowing orifices 72*b*. The eight sets of the air blowing holes 72*b* were distributed in the lengthwise direction of the air nozzle, and the four air blowing orifices 72*b* in each set were arranged in the circumferential direction of the air nozzle, with intervals of approximately 90°. With the provision of this structural arrangement, air was evenly blown into the toner supply container in terms of the circumferential direction as well as lengthwise direction, making it possible to clean the interior of the toner supply container without missing any spots.

Reciprocally moving the air nozzle in the lengthwise direction of the toner supply container 301, that is, in the direction parallel to the axial direction of the conveying member 302, while blowing air out of the air nozzle, improves the cleaning efficiency.

Referring to FIG. 26, for spacial efficiency, the interior of the toner supply container 301 was cleaned by suctioning air through the base portion 72*a* of the air nozzle 72 connected to the toner inlet 301*i*, while blowing air into the toner supply container 301 through the air nozzle 72 inserted through the toner inlet 301*i*.

More specifically, the air nozzle 72 is directly connected to the outlet 73*a* of a blower 73 as shown in FIG. 26. An intake duct 74 which perfectly fits with the toner inlet 301*i* is connected to the inlet 75*a* of a blower 75. The capacity of the blower 75 is greater than that of the blower 73. As the blowers 73 and 75 are activated, air is suctioned into the blower 73 through the intake duct 73*b* and compressed. The compressed air is sent into the air nozzle 72 through the outlet 73*a*, and is blown into the container main structure 301A through the air blowing orifices 72*b* of the air nozzle 72, removing the foreign substances such as deteriorated toner particles from the interior surface of the toner supply container 301. Then, the air which contains the removed foreign substances is suctioned by the blower 75 into the blower 75 through the exhaust duct 74 and inlet 75*a*, and then, is discharged from the outlet 75*b*. Although not illustrated, the outlet 75*b* is connected to a dust collecting apparatus, by which the foreign substances such as toner particles are captured.

The timing with which air begins to be blown into, or suctioned out of, the toner supply container 301 may be coincidental, or air may begin to be blown into the toner supply container 301 after the loose portions of the foreign substances such as toner particles are virtually suctioned out of the toner supply container.

Rotating the toner supply container 301 (direction indicated by the rotational arrow mark on the right (top) end of FIG. 26) while air is blown into, or suctioned out of, the toner supply container 301 assures that air is blown at the entirety of the internal surface and corners of the toner supply container, minimizing the amount of the foreign substances such as toner particles which fail to be removed. The rotational axis (represented by the line on the right (top) end of FIG. 26), about which the toner supply container 301 is rotated during this cleaning process is desired to be made coincidental with the approximate center of the cross section of the toner supply container 301, perpendicular to the lengthwise direction of the toner supply container 301. With this arrangement, the foreign substances which have accumulated in the areas such as the area below the conveying maker 302 (semicircular portion 301*g* in FIG. 8), which is difficult for the blown air to reach, fall out, improving cleaning efficiency. In this embodiment, however, the air nozzle 72 was inserted through the toner inlet 301*i*, the rotational axis about which the toner supply container 301 was rotated for cleaning was made coincidental with the axial line of the air nozzle 72, that is, the line which runs through the center of the toner inlet 301*i*, in parallel to the conveying member 302.

The above described method for cleaning the toner supply container 301 structured as described before was tested in the following manner. First, a brand-new toner supply container 301, which has not been filled with toner, was filled with approximately 10 g of foreign substances such as paper scraps or waste pieces of thread. Then, while rotating this toner supply container 301 at a rotational velocity of 15 rpm, air was blown into the container 301 for 20 seconds at the same time as air was suctioned out of the container 301. Regarding the blowing of air into the container 301, the air pressure was adjusted so that the amount (flow rate) by which air was blown into the container 301 became 0.5 $m^3$/min. Regarding the suctioning of air out of the container 301, the negative air pressure was adjusted so that the amount (flow rate) by which air was suctioned became 2.2 $m^3$/min. As a result, the amount of the foreign substances in the container 301 was reduced to no more than 1 g. When the container 301 was cleaned without rotating it, approximately 3 g of foreign substances remained below the conveying member 302, confirming that the rotation of the container 301 improved the cleaning efficiency.

The amount by which air is suctioned, and the amount by which air is blown, can be measured with the use of any of the well known methods and devices.

While a toner supply container is cleaned, the toner inlet remains airtightly sealed with a cleaning apparatus.

As described above, this embodiment can prevent negative pressure from deforming a toner supply container, even when air is blown into a toner supply container through the toner inlet 301 while suctioning the air out of the toner inlet 301*i*, under the condition that the amount by which air is suctioned is set to be greater than the amount by which air is blown into the toner supply container, for the purpose of improving cleaning efficiency.

Embodiment 2

Figure 27:
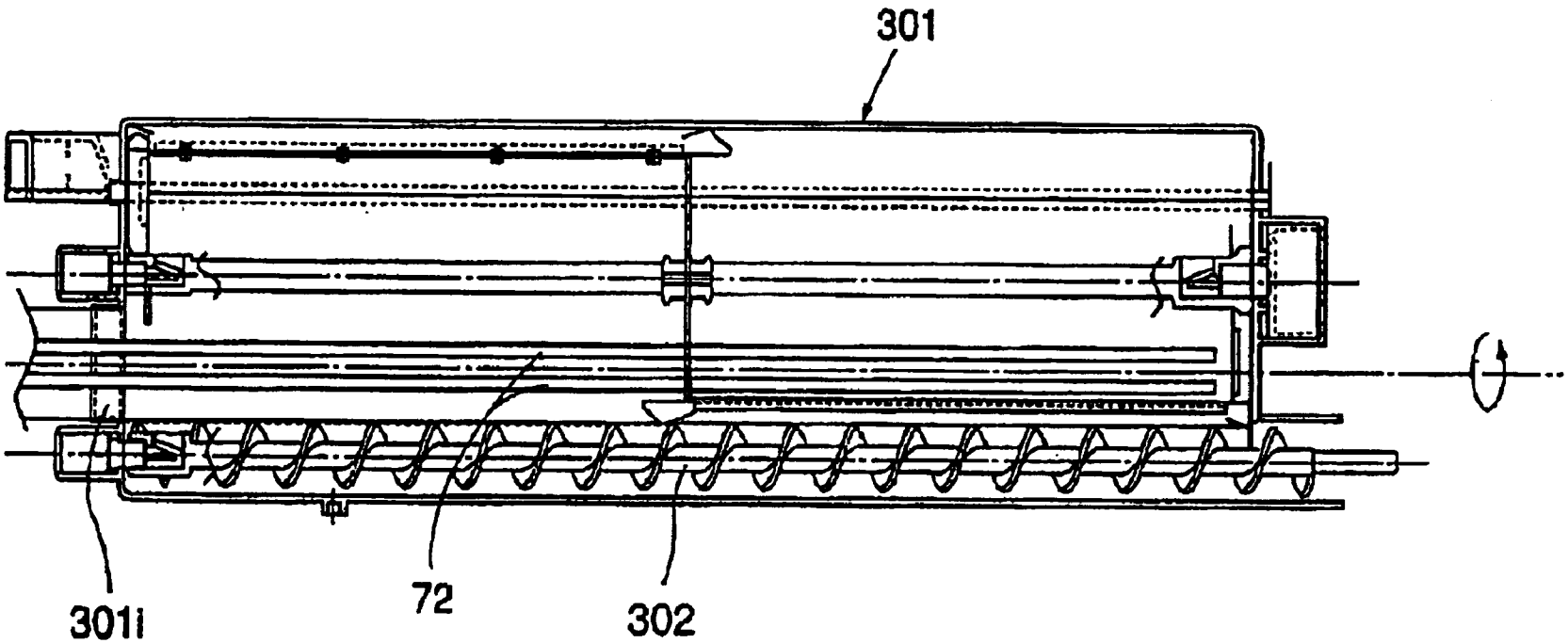
FIG. 27 is a vertical sectional view, parallel to the lengthwise direction, of the toner supply container in the second embodiment of the present invention.
Figure 28:
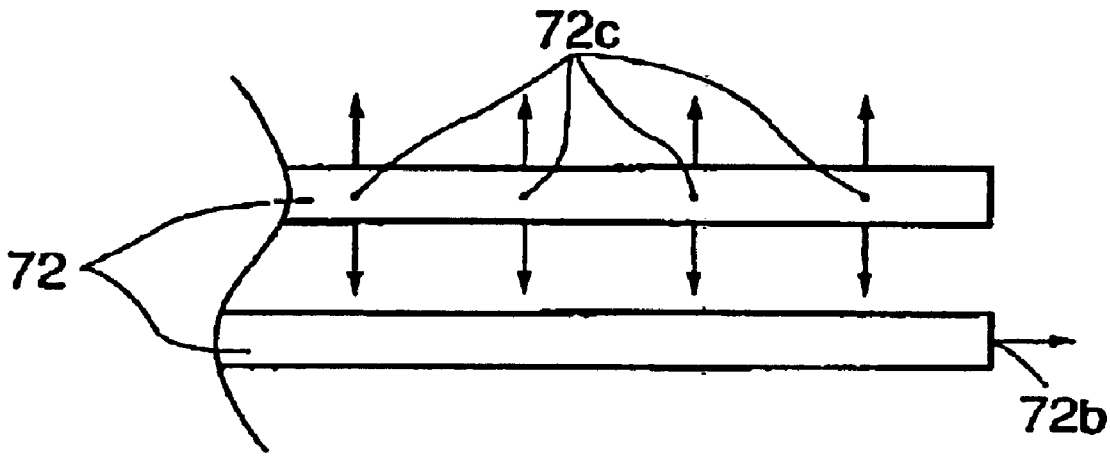
FIG. 28 is an enlarged view of the air nozzle in the second embodiment of the present invention.

FIG. 27 is a sectional view of the toner supply container in the second embodiment of the present invention. FIG. 27 is virtually the same as FIG. 26, except that in FIG. 27, two air nozzles for blowing air into the toner supply container have been inserted through the toner inlet 301*i*. Each air nozzle 72 is parallel to the conveying member 302. Referring to FIG. 28, one of the two air nozzles is provided with an orifice 72*b*, and the other is provided with a plurality of orifices 72*c*, which are different in aim from the orifice 72*b*. Further, it is possible for the air pressure applied to one air nozzle and the air pressure applied to the other to be set and adjusted independently from each other. Therefore, it is possible to generate a smoother air flow through the toner supply container, improving cleaning efficiency, during the cleaning.

Incidentally, in this embodiment, one of the two air nozzles 72 (bottom nozzle in FIGS. 27 and 28) is provided with a single orifice 72*b* aimed in the lengthwise direction of the toner supply container 301. The air pressure is adjusted so that the amount (flow rate) by which air is blown into the toner supply container 301 becomes 0.3 $m^3$/min.

The other air nozzle 72 (top nozzle in FIGS. 27 and 28) is the same as the one in the first embodiment: it is provided with 32 air blowing orifices 72*c*, which are divided into eight sets, each of which comprises four air blowing orifices 72*c*;

the eight sets of the air blowing orifices 72*c* are distributed in the lengthwise direction of the air nozzle; and the four air blowing orifices 72*c* in each set are arranged in the circumferential direction of the air nozzle, with intervals of approximately 90°. The air pressure applied to this air nozzle is adjusted so that the amount (flow rate) by which air is blowing into the toner supply container 301 becomes 0.7 $m^3$/min. Otherwise, the second embodiment is the same in structure as the first embodiment.

The above described method for cleaning the toner supply container 301 structured as described before was tested in the following manner. First, a brand-new toner supply container 301, which had not been filled with toner, was filled with approximately 10 g of foreign substances such as paper scraps or waste pieces of thread. Then, the toner supply container 301 was cleaned with the use of the cleaning method in this embodiment. As a result, the foreign substances within the container 301 were reduced to no more than 0.1 g. Although the number of the air nozzles in the second embodiment was two, the number of the air nozzles may be three or more.

Embodiment 3

Next, a process for remanufacturing a used toner supply container which has been completely depleted of toner will be described.

In the first step of the process, the sealing member 311 for airtightly sealing the toner inlet 301*i* through which toner is filled into the toner supply container 301, and the sealing member 303 for airtightly sealing the toner outlet 301*a* through which toner is discharged from the toner supply container 301, are removed from the toner supply container 301. These sealing members 303 and 311 had been pressed into the toner outlet 301*a* and toner inlet 301*i*, respectively. Therefore, they are pulled off with the use of such a tool as a pair of pliers, or removed with the use of an automatic sealing member removing machine.

In the second step of the process, the toner supply container is cleaned. In other words, a small amount of the foreign substance such as toner particles, which is remaining in the toner supply container 301, or adhering to the interior of the container 301, can be removed by blowing air into the container 301 from the air nozzle 72 inserted into the toner inlet 301*i*, while suctioning air out of the container 301 through the toner inlet 301*i* and rotating the toner supply container 301 with the use of the apparatus (unshown) for rotating the toner supply container 301, as described above regarding the first and second embodiments.

When a used toner supply container 301, which was structured as described before, and in which approximately 40 g of toner was remaining, was cleaned with the use of the cleaning method in the second embodiment, the amount of the residual toner within the toner supply container 301 was reduced to no more than 3 g.

After the cleaning, an optical fiber scope is inserted into the toner supply container 301 through the toner inlet 301*i* to examine the stirring member 305 in the container 301. The condition of the stirring member 305 is guessed based on the angle by which the stirring member 305 became twisted. The angle by which the stirring member became twisted is determined by comparing the markings placed on both lengthwise ends of the stirring member 305, and the corresponding portions of the toner supply container main structure 301A.

Since this examination of the stirring member 305 in the used toner supply container 301 is carried out after the cleaning of the interior of the toner supply container 301, the stirring member 305 can be easily examined regarding the presence or absence of the anomalies (collapsing of the stirring shaft, or damages to the stirring blade).

In the third step of the process, the toner outlet 301*a* is sealed with the sealing member 303; the sealing member 303 is pressed into the toner outlet 301*a* by holding the sealing member 303 with the use of a pair of pliers or the like.

In the fourth step, toner is filled into the toner supply container 301 through the toner inlet 301*i*, with the use of a weight (volume) counting feeder.

In the fifth step, the sealing member 311 is pressed into the toner inlet 301*i* with the application of light pressure; the sealing member 311 is pressed into the toner inlet 301*i* with the use of a pressing device or the like.

This concludes the remanufacturing of the toner supply container 301 in accordance with the present invention.

In the preceding descriptions of the preferred embodiments of the present invention, the toner supply container was described as a toner supply container, the main structure of which does not rotate relative to an image forming apparatus when supplying the image forming apparatus with toner. However, the present invention is also applicable to such a toner supply container, the main structure of which rotates relative to the image forming apparatus when supplying the image forming apparatus with toner.

According to the above described embodiments of the present invention, the following effects can be obtained:

(1) Foreign substances which became adhered to the interior of a toner supply container, or are remaining in the toner supply container, can be virtually entirely removed.

(2) The provision of the structural design that allows the ambient air to flow into a toner supply container while cleaning the toner supply container makes it possible to prevent the toner supply container from being deformed by negative pressure, even when the amount by which air is suctioned out of the toner supply container is greater than the amount by which air is blown into the toner supply container.

(3) When remanufacturing a toner supply container, the interior of the toner supply container can be easily cleaned.

(4) The interior of a toner supply container is virtually perfectly cleaned, making it possible to confirm the anomalies, such as deformations (bending and/twisting of the stirring shaft, and/or damages to the stirring blade, which are caused by the toner supply container usage) of the stirring member disposed within the toner supply container, from outside the toner supply container, and therefore, making it easier to determine whether or not the toner supply container can be remanufactured.

While the invention has been described with reference to the structures disclosed herein, it is not confined to the details set forth, and this application is intended to cover such modifications or changes as may come within the purposes of the improvements or the scope of the following claims.

What is claimed is:

1. A cleaning method for cleaning a developer container, comprising:

a blowing step of blowing air into said developer container at a first flow rate; and a sucking step of sucking air from the developer container at a second flow rate, which is larger than the first flow rate, thereby sucking developer from the developer container to clean the developer container, wherein said blowing step and said sucking step are concurrently carried out through an opening formed in the developer container, while ambient air is flowing into the developer container through an ambient air inlet.

2. A method according to claim 1, wherein the ambient air inlet is disposed at a position opposite from the opening with respect to a longitudinal direction of said developer container.

3. A method according to claim 1, further comprising an inserting step of inserting an air nozzle for blowing air into the developer container through the opening.

4. A method according to claim 3, wherein in said blowing step air is blown in directions perpendicular to a longitudinal direction of the air nozzle through a plurality of air blowing ports provided in the air nozzle and arranged at different positions with respect to a circumferential direction of the air nozzle.

5. A method according to claim 3, wherein in said inserting step, first and second air nozzles are inserted into the developer container through the opening, and in said blowing step air is blown through a plurality of air blowing ports of the first air nozzle in directions perpendicular to a longitudinal direction of the first air nozzle at different positions with respect to a circumferential direction of the first air nozzle, and air is blown through an air blowing port provided at a longitudinal end of the second air nozzle in a longitudinal direction of the second air nozzle.

6. A method according to claim 5, wherein a blowing rate of the first air nozzle is larger than a blowing rate of the second air nozzle.

7. A method according to claim 1, wherein said blowing step and suction step are carried out concurrently while the developer container is rotated.

8. A method according to claim 1, wherein said blowing step and said sucking step are carried out concurrently while reciprocating the developer container in a longitudinal direction thereof.

9. A method according to claim 1, wherein said blowing step starts after starting said sucking step.

10. A method according to claim 1, further comprising a step of connecting a first blower to be used in said blowing step and a second blower to be used to suck air in said sucking step to the opening.

11. A recycling method for recycling a developer container, comprising:

a removing step of removing first and second used sealing members sealing first and second openings, respectively, provided in the developer container;

a blowing step of blowing air into the developing container at a first flow rate;

a sucking step of sucking air from the developer container at a second flow rate, which is larger than the first flow rate, thereby sucking developer from the developer container to clean the developer container, a filling step of filling the developer container with developer; and a mounting step of mounting first and second new sealing members to seal the first and second openings, wherein said blowing step and said sucking step are concurrently carried out through the first opening, while ambient air is flowing into the developer container through the second opening.

12. A method according to claim 11, wherein the second opening is disposed at a position opposite from the first opening with respect to a longitudinal direction of the developer container.

13. A method according to claim 11, further comprising an inserting step of inserting an air nozzle for blowing air into the developer container through the first opening.

14. A method according to claim 13, wherein in said blowing step air is blown in directions perpendicular to a longitudinal direction of the air nozzle through a plurality of air blowing ports provided in the air nozzle and arranged at different positions with respect to a circumferential direction of the air nozzle.

15. A method according to claim 13, wherein in said inserting step, first and second air nozzles are inserted into the developer container through the first opening, and in said blowing step air is blown through a plurality of air blowing ports of the first air nozzle in directions perpendicular to a longitudinal direction of the first air nozzle at different positions with respect to a circumferential direction of the first air nozzle, and air is blown through an air blowing port provided at a longitudinal end of the second air nozzle in a longitudinal direction of the second air nozzle.

16. A method according to claim 15, wherein a blowing rate of the first air nozzle is larger than a blowing rate of the second air nozzle.

17. A method according to claim 11, wherein said blowing step and sucking step are carried out concurrently while the developer container is rotated.

18. A method according to claim 11, wherein said blowing step and said sucking step are carried out concurrently while reciprocating the developer container in a longitudinal direction thereof.

19. A method according to claim 11, wherein said blowing step starts after starting said sucking step.

20. A method according to claim 11, further comprising step of connecting a first blower to be used in said blowing step and a second blower to be used to suck air in said sucking step to the first opening.

* * * * *

UNITED STATES PATENT AND TRADEMARK OFFICE

CERTIFICATE OF CORRECTION

PATENT NO. : 6,802,910 B2
DATED : October 12, 2004
INVENTOR(S) : Katsuya Murakami et al.

It is certified that error appears in the above-identified patent and that said Letters Patent is hereby corrected as shown below:

Column 1,
Line 38, "be" should read -- to be --.

Column 7,
Line 32, "20 mm 40 mm" should read -- 20 mm-40 mm --.

Column 13,
Line 36, "assembled In" should read -- assembled. In --.

Column 14,
Line 27, "mains" should read -- main --.

Column 15,
Line 57, "the" should read -- of the --.

Column 16,
Line 47, "never" should read -- member --.

Column 17,
Line 30, "moved" should read -- move --.

Column 19,
Line 53, "0.5 mm 5 mm" should read -- 0.5 mm—5 mm --.

Column 20,
Line 5, "silicon" should read -- silicone --.

Column 21,
Line 66, "maker" should read -- member --.

Column 22,
Line 37, "301" should read -- 301*i* --.

Column 24,
Lines 19 and 23, "relative" should read -- relatively --.

UNITED STATES PATENT AND TRADEMARK OFFICE

CERTIFICATE OF CORRECTION

PATENT NO. : 6,802,910 B2
DATED : October 12, 2004
INVENTOR(S) : Katsuya Murakami et al.

It is certified that error appears in the above-identified patent and that said Letters Patent is hereby corrected as shown below:

Column 25,
Line 8, "said" should read -- the --.

Signed and Sealed this

Nineteenth Day of April, 2005

JON W. DUDAS
*Director of the United States Patent and Trademark Office*